US006832687B2

(12) United States Patent
Davis

(10) Patent No.: US 6,832,687 B2
(45) **Date of Patent: *Dec. 21, 2004**

(54) BEVERAGE AND FOOD CARRIER

(75) Inventor: Paul S. V. Davis, Newport Beach, CA (US)

(73) Assignee: Easy Carry, LLC, Costa Mesa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/219,079

(22) Filed: Aug. 14, 2002

(65) Prior Publication Data

US 2002/0185387 A1 Dec. 12, 2002

Related U.S. Application Data

(63) Continuation of application No. 09/893,361, filed on Jun. 26, 2001, now Pat. No. 6,443,308.
(60) Provisional application No. 60/214,267, filed on Jun. 26, 2000.

(51) Int. Cl.[7] ..... A45C 11/20
(52) U.S. Cl. ..... 206/549; 206/194
(58) Field of Search ..... 266/143, 147, 266/152, 162, 167, 170, 174, 175, 180, 184, 187, 188, 193, 198, 200, 203, 427, 542, 546, 549, 509, 511, 217

(56) References Cited

U.S. PATENT DOCUMENTS

| | | | | |
|---|---|---|---|---|
| 2,728,484 A | | 12/1955 | Farrington | |
| 2,759,629 A | | 8/1956 | Sargent | |
| 2,828,047 A | | 3/1958 | Weiselberg | |
| 2,991,908 A | | 7/1961 | Conescu | |
| 3,225,959 A | | 12/1965 | Jamison | |
| 3,565,323 A | | 2/1971 | Katzenmeyer et al. | |
| 3,744,704 A | | 7/1973 | Struble | |
| 3,868,140 A | | 2/1975 | Gordon | |
| 4,053,099 A | | 10/1977 | Lock | |
| 4,155,502 A | | 5/1979 | Forte | |
| 4,744,613 A | | 5/1988 | Brantingham et al. | |
| 4,895,256 A | | 1/1990 | Johnston | |
| 5,240,136 A | * | 8/1993 | Patterson et al. | 206/217 |
| 5,249,700 A | | 10/1993 | Dumke | |
| 5,325,962 A | * | 7/1994 | Ouellette | 206/216 |
| 5,415,277 A | * | 5/1995 | Berntsen | 206/162 |
| D367,409 S | | 2/1996 | Hunter | |
| 5,501,338 A | | 3/1996 | Preston | |
| 5,524,814 A | | 6/1996 | Davis | |
| 5,609,379 A | | 3/1997 | Harrelson | |
| 5,765,684 A | | 6/1998 | Van Dore et al. | |
| 5,788,081 A | | 8/1998 | Bates | |
| 5,797,486 A | | 8/1998 | Picciolo | |
| 5,813,540 A | | 9/1998 | Vollbrechet et al. | |
| 5,833,056 A | | 11/1998 | Goldman | |
| 5,860,590 A | * | 1/1999 | Blomfield et al. | 229/165 |
| 5,918,751 A | * | 7/1999 | Kelly | 206/511 |
| 5,927,502 A | | 7/1999 | Hunter | |

* cited by examiner

*Primary Examiner*—Luan K. Bui
(74) *Attorney, Agent, or Firm*—Knobbe, Martens, Olson & Bear, LLP

(57) ABSTRACT

A two-piece collapsible carrier for food and beverages. The lower carrier has a bottom and four side walls particularly adapted to carrier beverages in different sized containers. The side walls have uppermost edges higher than the tallest beverage containers to be normally carried. An upper food top having a bottom and side walls is carried over said lower carrier with the bottom of said upper tray resting on the uppermost edges of said lower carrier so that in normal use, the attitudes of the tray and beverage carrier remain the same.

21 Claims, 28 Drawing Sheets

BEVERAGE AND FOOD CARRIER

PRIORITY CLAIM

This continuation application claims the benefit of U.S. Provisional Application No. 60/214,267 filed Jun. 26, 2000, entitled "Beverage And Food Carrier" and U.S. application Ser. No. 09/893,361 filed on Jun. 26, 2001 now U.S. Pat. No. 6,443,308.

FIELD OF THE INVENTION

The preferred embodiments of this invention relate to inexpensive, disposable carriers for beverages, food and other items.

BACKGROUND OF THE INVENTION

The prior art includes a number of patents that show carriers for food and beverages. Representative prior art carriers are described in the Hunter U.S. Pat. Nos. 5,738,217 and 5,927,502. Although the carriers described in these patents are improvements over other carriers, the Hunter carriers have several significant deficiencies. Thus, cups of various sizes are not easily carried since the Hunter carriers are not designed to carry beverage containers of various sizes and shapes. The Hunter carriers are bottomless so that the beverage cups necessarily touch the stadium ground or floor when the carrier is placed on the ground or floor. And, the Hunter carriers do not insure that the attitude of the food tray remains horizontal. Rather, upward movement of the beverage cups tend to tilt the tray, especially if cups of different sizes are used or the cups are not uniformly distributed in the carrier.

SUMMARY OF THE INVENTION

The preferred embodiments of this invention provide an inexpensive beverage and food carrier having a wide variety of uses. One particular use is in ballparks or stadium to carry food from a food and drink stand to one's seat. A particular feature of this preferred embodiment is that beverage containers of different sizes may be conveniently carried. Thus, the preferred embodiments include a two-piece carrier, formed from only two pieces of cardboard, a lower carrier having a carrying handle and an upper tray for food and like items.

The beverage containers rest upon a bottom provided by four interlocking cardboard flaps. These beverage cups and containers, be they foam, paper, plastic, round, square or otherwise, are thus protected by the carrier bottom from touching the stadium floor. The upper food tray slides over the handle and rests upon the top edges of the side walls forming the lower container.

In the preferred embodiments, the side walls extend upwardly from the container floor higher than the height of the beverage containers, with their top edges supporting the bottom of the food tray. As a result, the attitude of tray is maintained parallel to the beverage carrier.

Another significant advantage of carriers constructed in accordance with the preferred embodiments of this invention is that the carrier as constructed is collapsed for convenient shipping and storing and quickly and easily assembled at the ballpark or football stadium. The collapsed carrier is advantageously only five times the thickness of the sheet of cut material used to form the carrier.

DETAILED DESCRIPTION OF THE PREFERRED EMBODIMENT

Figure 1A:
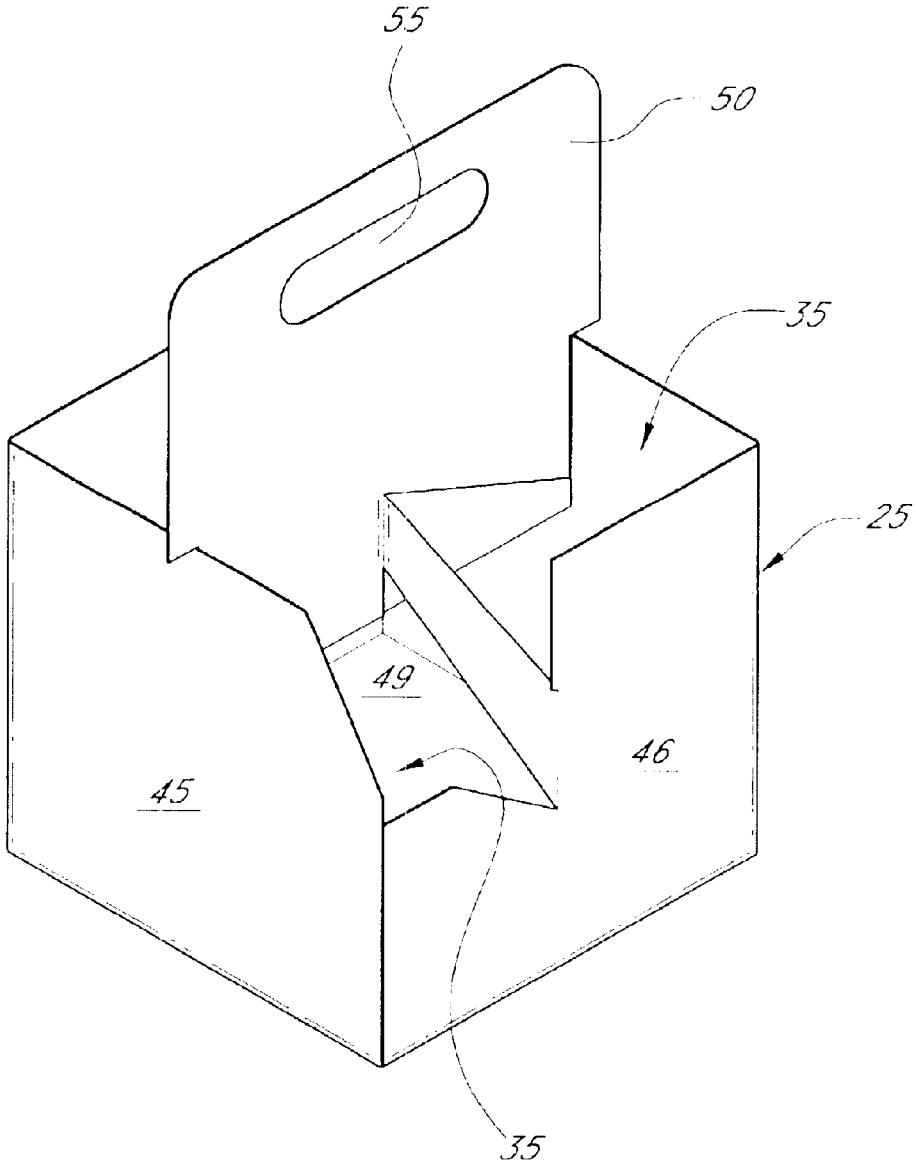
FIG. 1A is a perspective view of the lower beverage carrier of one embodiment of the present invention.
Figure 13:
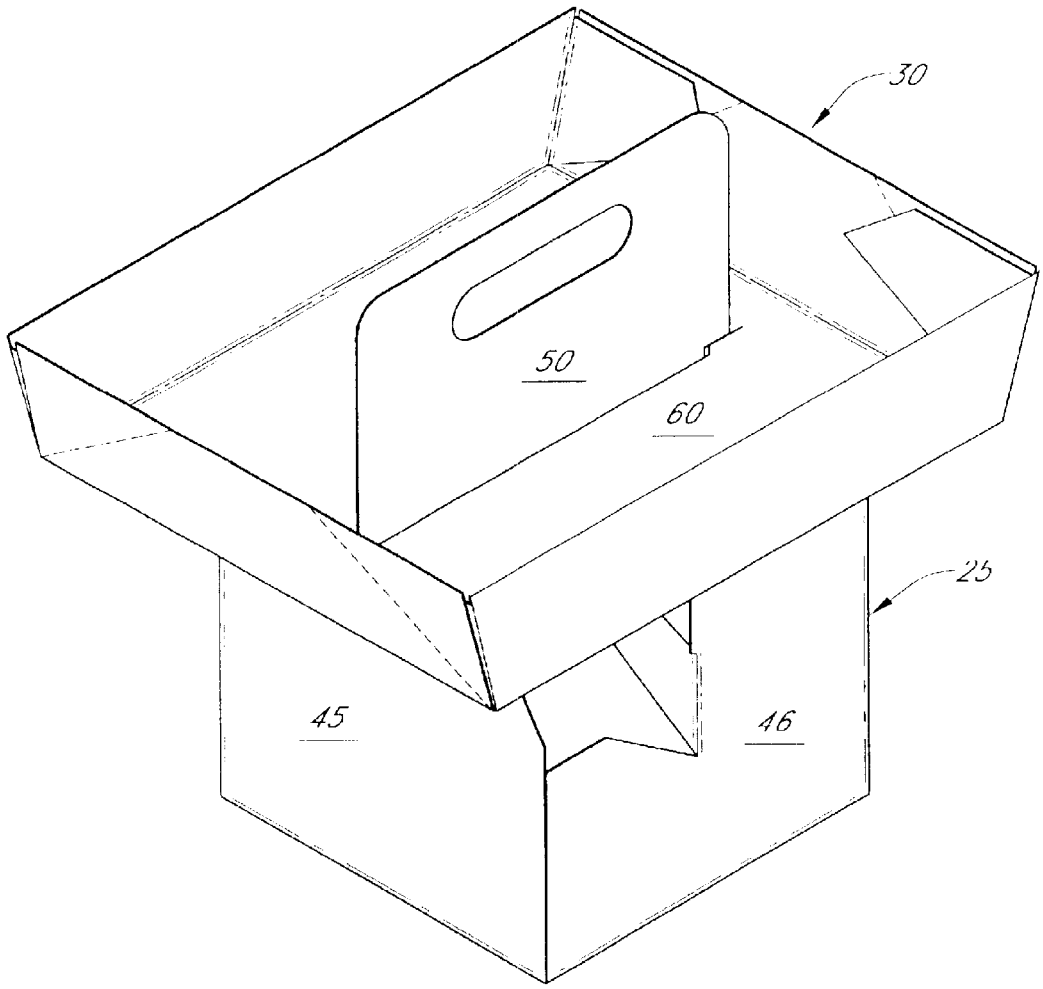
FIG. 13 is a perspective view showing the upper food tray mounted on its lower beverage carrier.

One preferred embodiment of the food and drink carrier constructed in accordance with this invention is shown in FIG. 13 and includes a lower beverage carrier 25 for holding paper or plastic cups or other containers of beverage and an upper food tray 30 supported on the uppermost edges of the outside walls. In the embodiment shown in the figures, the lower carrier has, as best seen in FIGS. 1A and 1B, four compartment pockets 35 in which, depending upon their diameter, four or more cups 40 or other containers (see FIG. 1B) can be carried.

A feature of this invention is that the lower carrier is adapted to carry any shape or configuration of beverage container normally sold in ball parks and stadiums. Further, although the embodiment shown provides four pockets 35, it will be apparent that the bottom carrier can be constructed to have fewer or greater number of pockets.

Figure 1B:
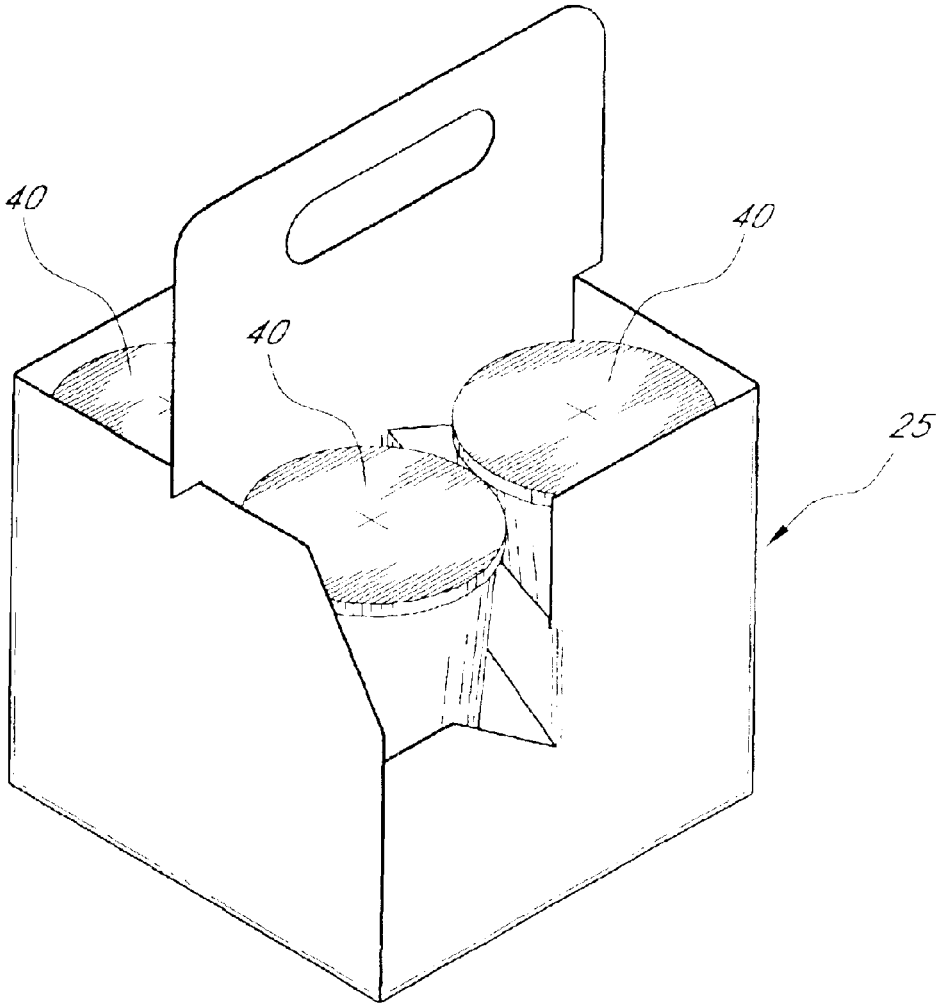
FIG. 1B is a perspective view of the lower beverage carrier shown with beverage containers placed within the carrier.
Figure 2:
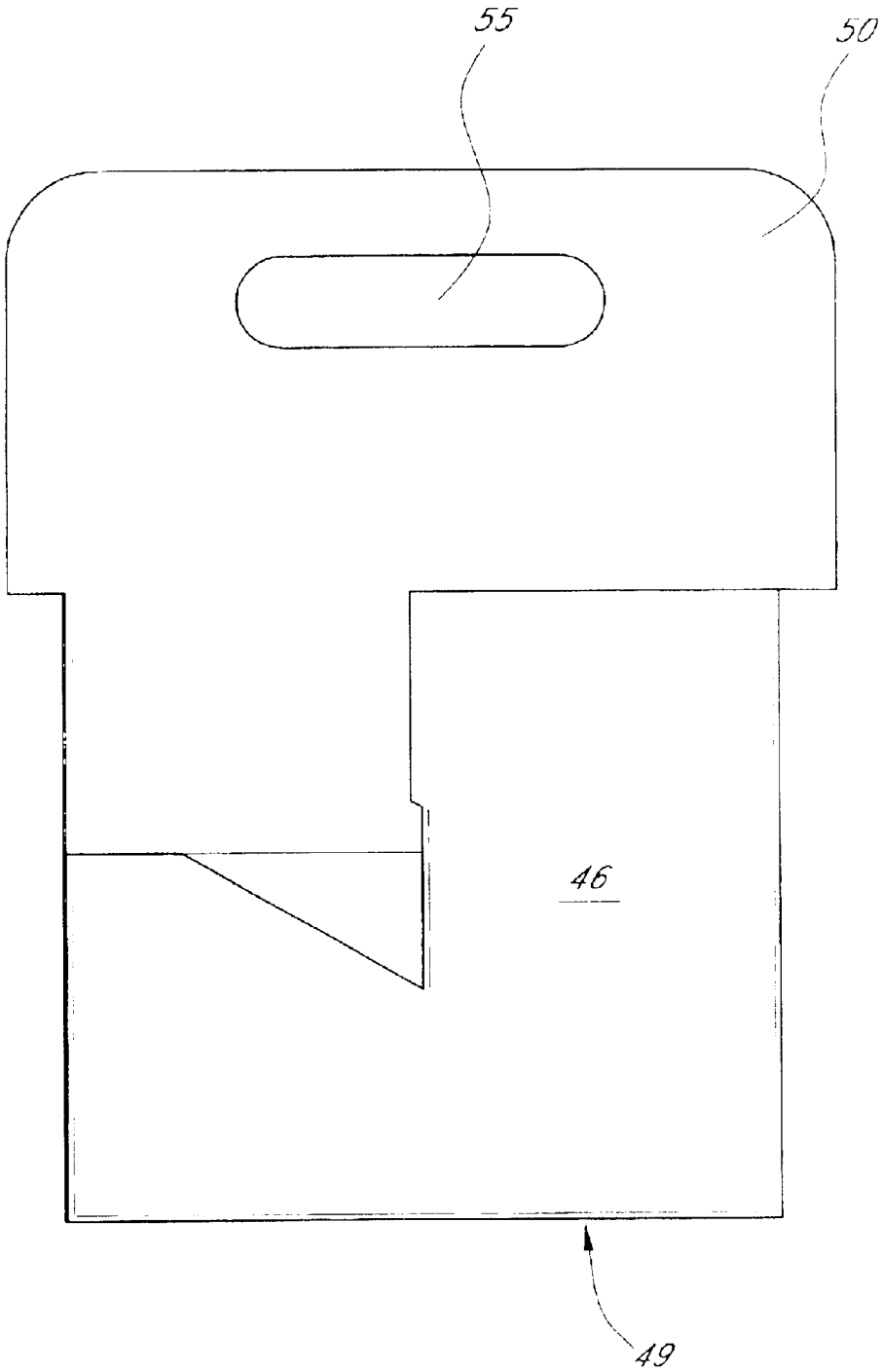
FIG. 2 is a first side elevation view of the lower beverage carrier.
Figure 3:
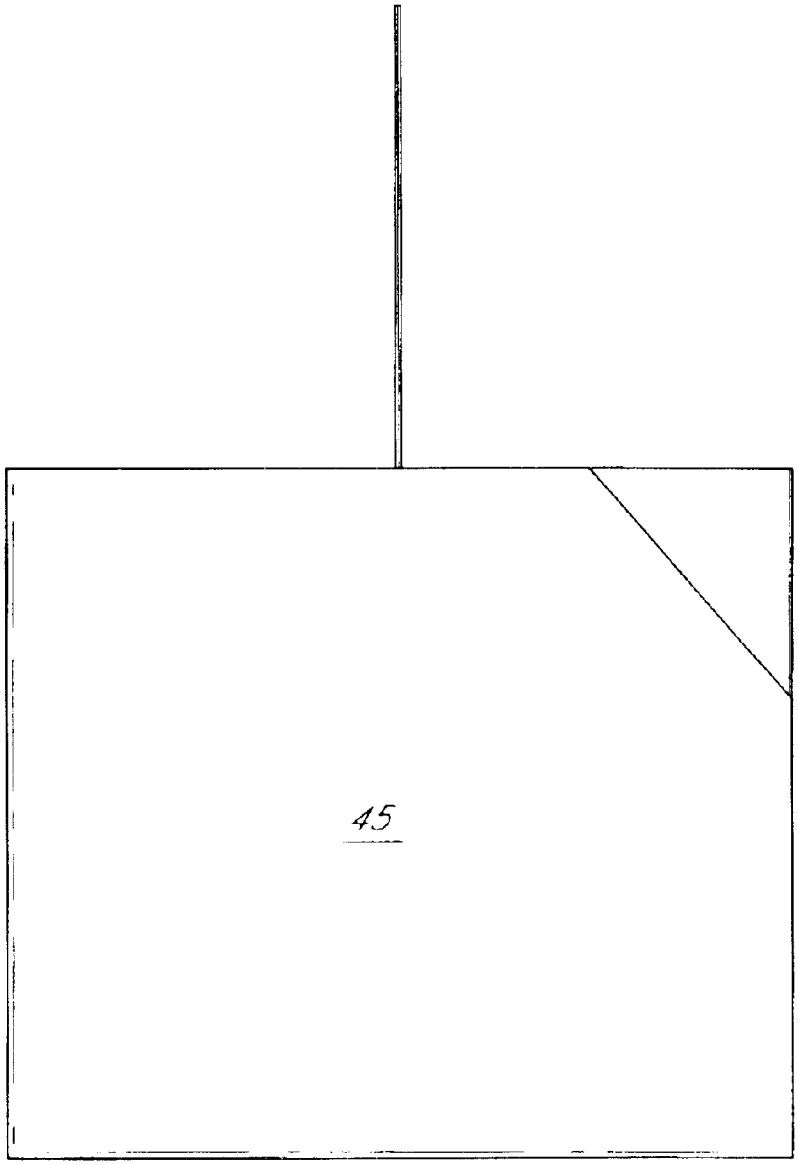
FIG. 3 is a second side elevational view of the beverage carrier.
Figure 4:
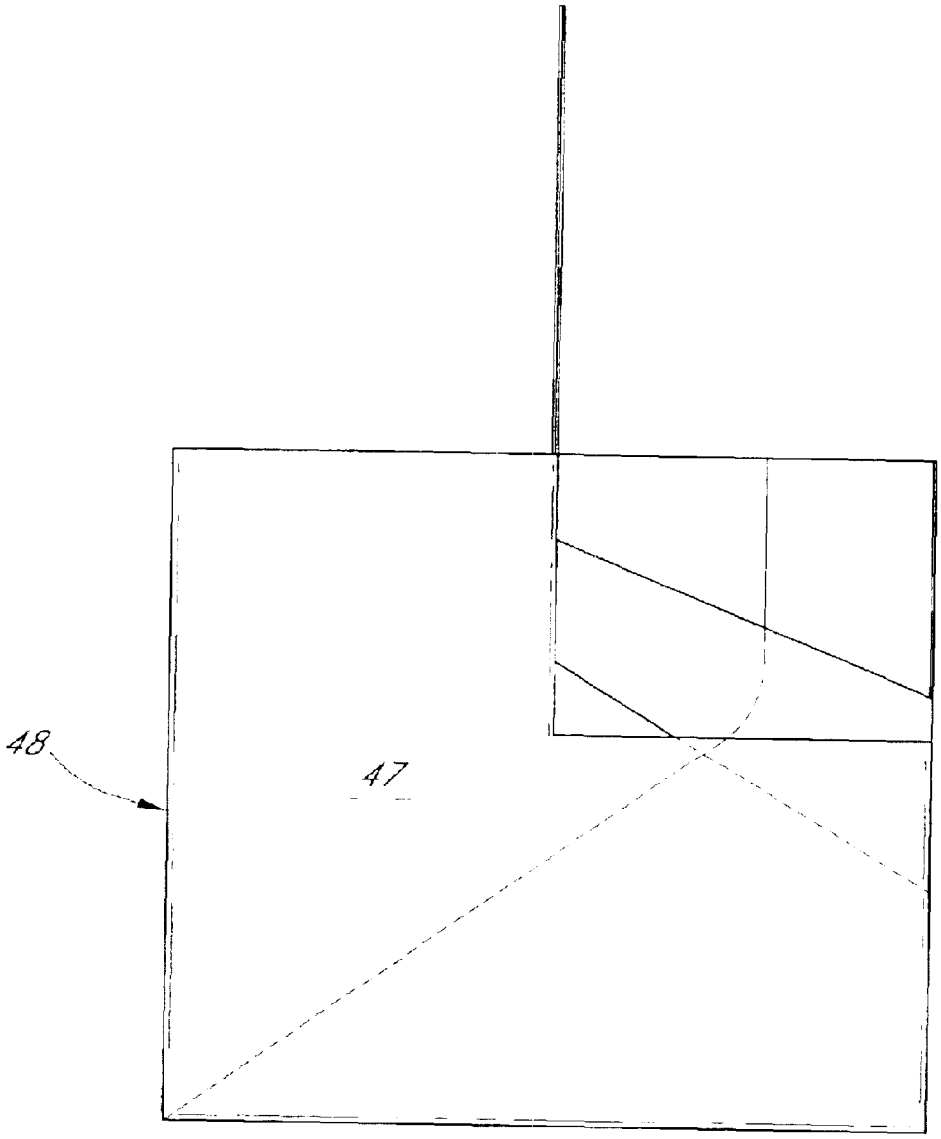
FIG. 4 is a third side elevational view of the beverage carrier.
Figure 16:
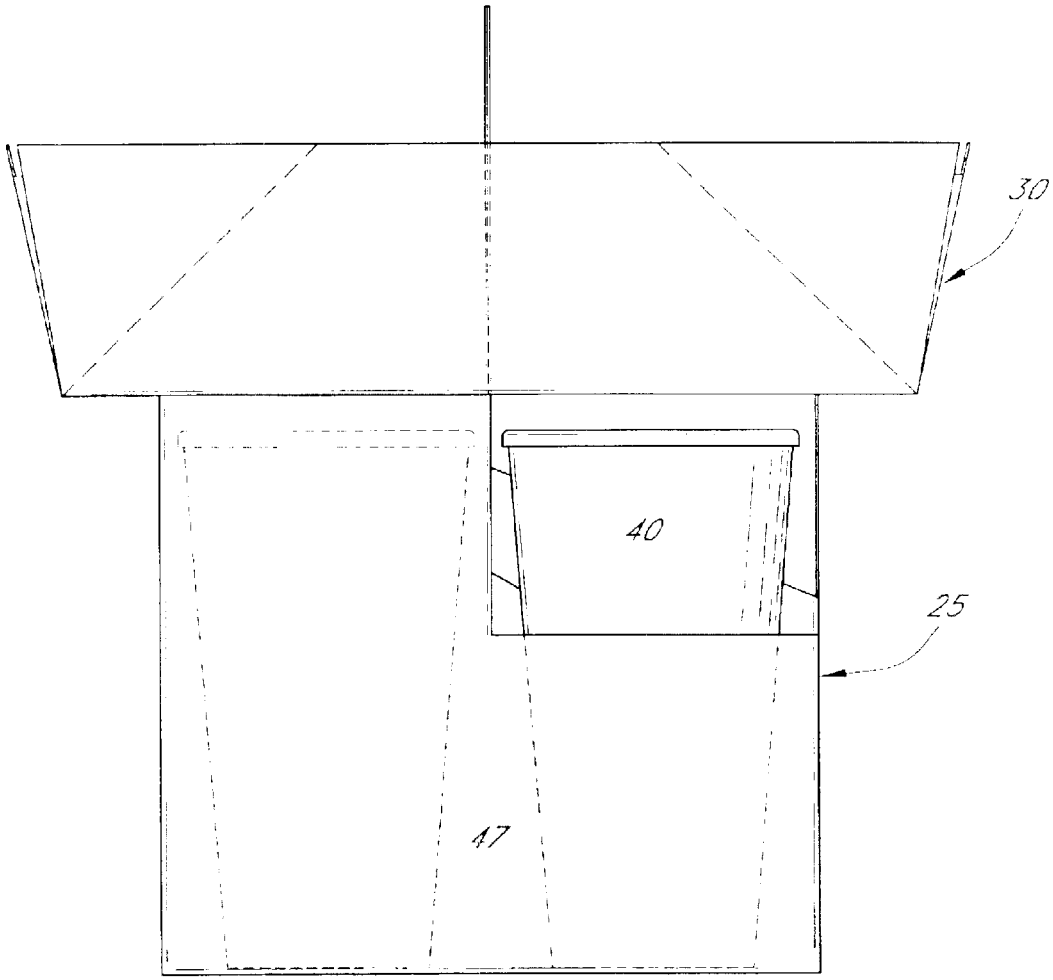
FIG. 16 is a side elevational view showing the upper food tray mounted on the lower beverage carrier.

As discussed below and as shown in FIGS. 1B and 16, the uppermost edges of the side walls 45, 46, 47, 48 of container 25 are, in the preferred embodiment, higher than the tallest cup 40 that will be normally placed within the container 25.

The beverage carrier 25 advantageously includes a bottom floor 49 under each of the pockets 35. This floor is provided by four interlocking bottom flaps.

The lower beverage carrier further includes an integral flat, generally rectangular handle 50 advantageously formed by two thickness of the same cardboard or other sheet material used to construct the lower carrier 25. An elongate opening 55 allows some of the fingers of one hand to pass through this opening 55 to more easily carry the beverage and food container.

Figure 7:
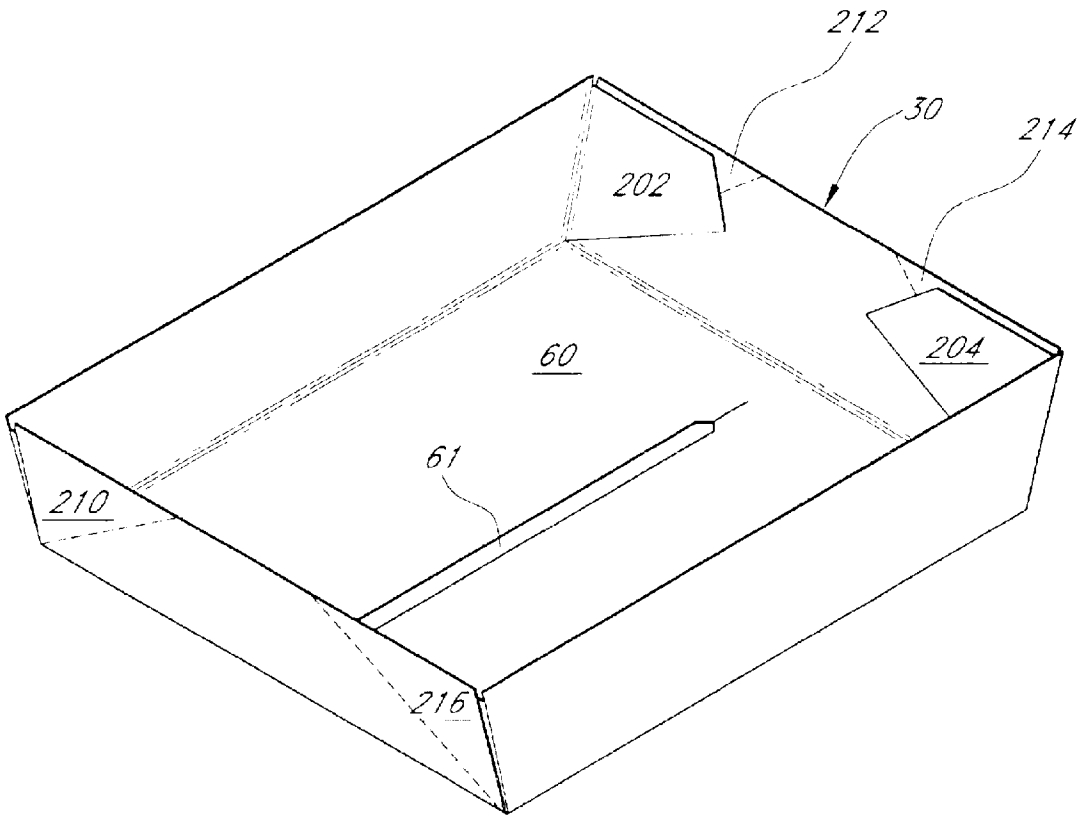
FIG. 7 is a top perspective view of the upper food tray.
Figure 8:
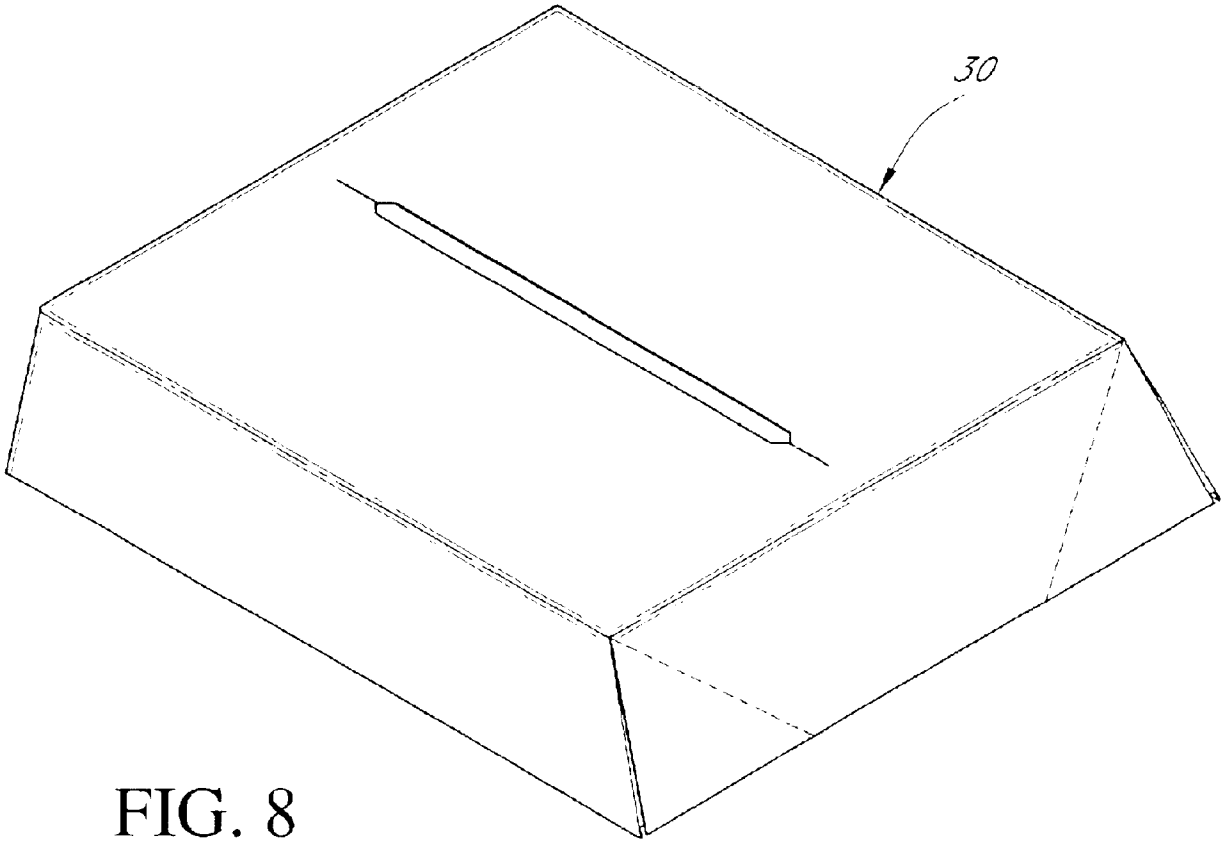
FIG. 8 is a bottom perspective view of the food tray.
Figure 9:
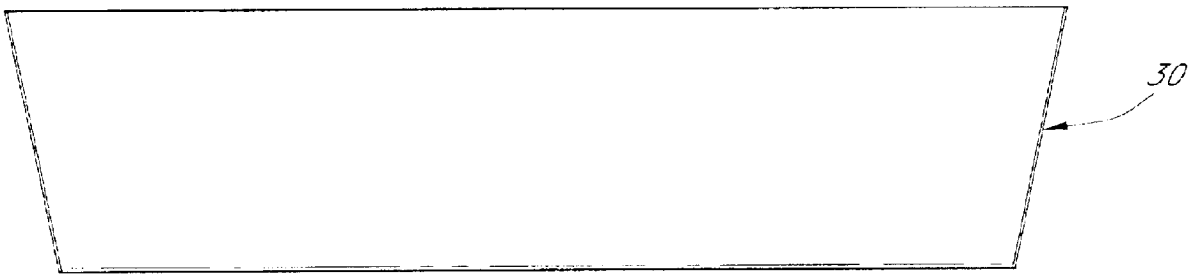
FIG. 9 is a first side elevational view of the food tray.
Figure 10:
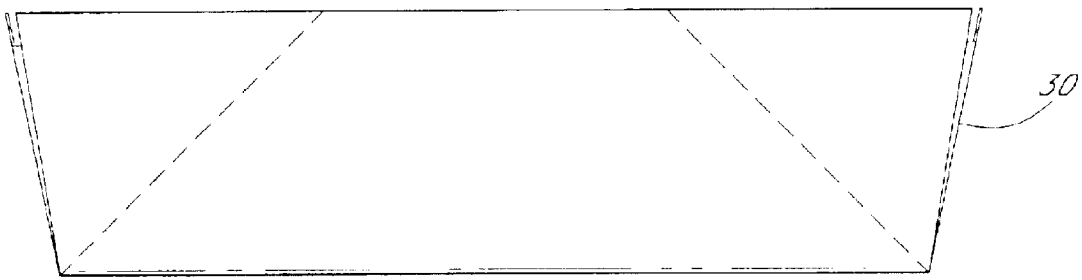
FIG. 10 is a second elevational view of the food tray.
Figure 11:
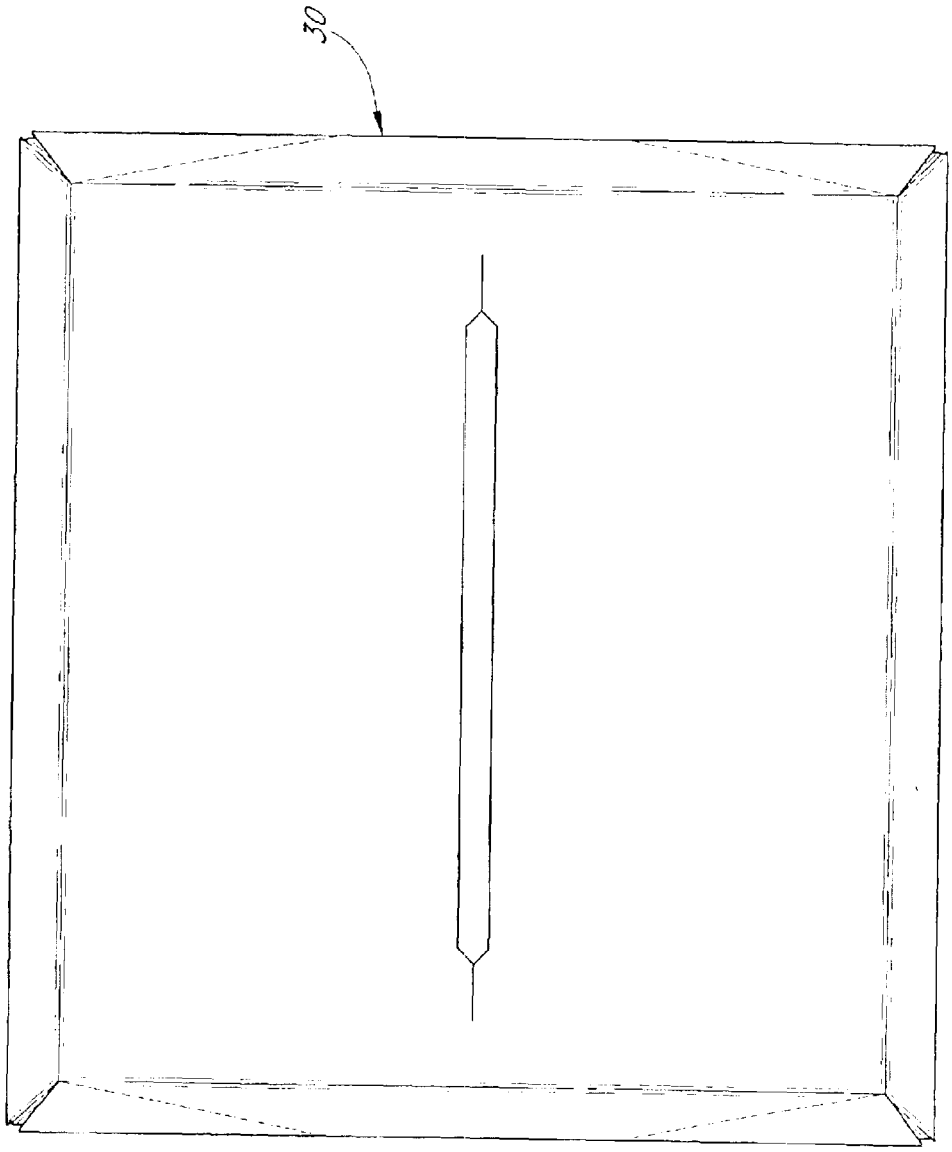
FIG. 11 is a bottom view of the food tray.
Figure 12:
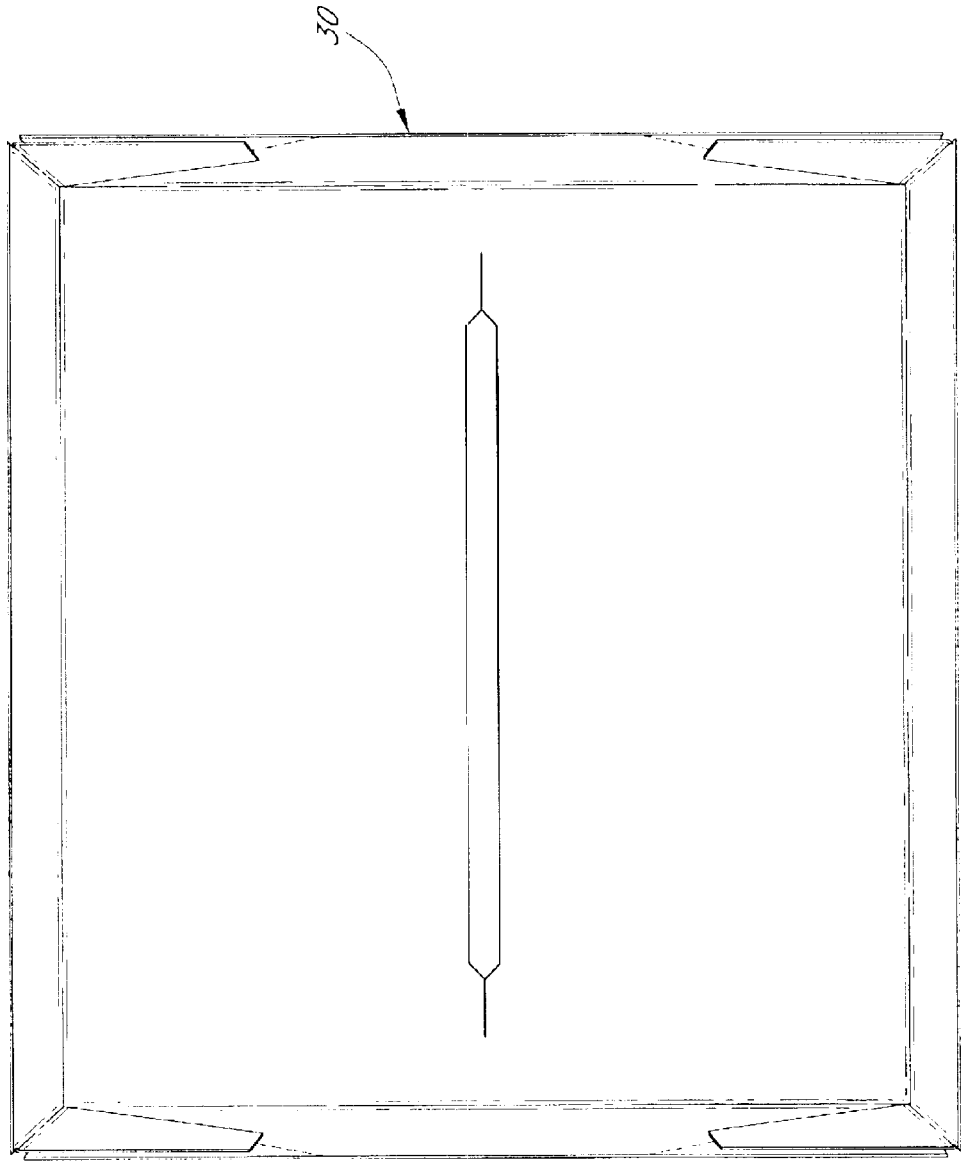
FIG. 12 is a top view of the food tray.

The upper food tray 30, best shown in FIGS. 7 and 13, has a base or bottom 60 that is advantageously larger than the area circumscribed by the side walls 45, 46, 47 and 48 of lower carrier 25. The bottom of food tray 30 includes an elongated slot 61 whose dimensions are somewhat larger than the cross-section of handle 50. As shown in FIG. 13, after the beverage cups are placed within the pockets 35, the tray 30 is slid down over the handle 50.

A significant feature of the preferred embodiments of this invention is that the upper food tray 30 is slid down over handle 50 until it rests on the uppermost top edges of the side walls 45, 46, 47 and 48 (see FIGS. 13 and 16). In this manner, the attitude of tray 30 is maintained horizontal with respect to the beverage carrier 25 and is not affected by the height, distribution or quantity of the beverage cups placed in the pockets 35. Moreover, in the preferred embodiments, the bottoms of the beverage cups advantageously rest on the floor 49 of the lower beverage container. As a result, placing a filled carrier 25 on the floor or seat of a stadium has no effect on the positions of either the beverage containers 40 inside the pockets 35 or the attitude of the tray 30.

Advantageously, the lower beverage carrier 25 and upper food tray 30 are each cut from a single sheet of suitable cardboard. See FIGS. 14 and 15, wherein solid inner lines indicate cut slits in the cardboard sheet and dotted lines indicate creases formed in the cardboard. In the following instructions, the interior faces of each of the side walls of the lower and upper carriers face upwardly in FIGS. 14 and 15. By way of specific example, carriers have been constructed in accordance with this invention in which the outside dimensions of the flat cut cardboard of FIG. 14 measured $36\frac{27}{36}$ inches by $16\frac{3}{8}$ inches and the outside dimensions of the flat cut cardboard of FIG. 15 measured 17 inches by 16 inches.

Figure 14:
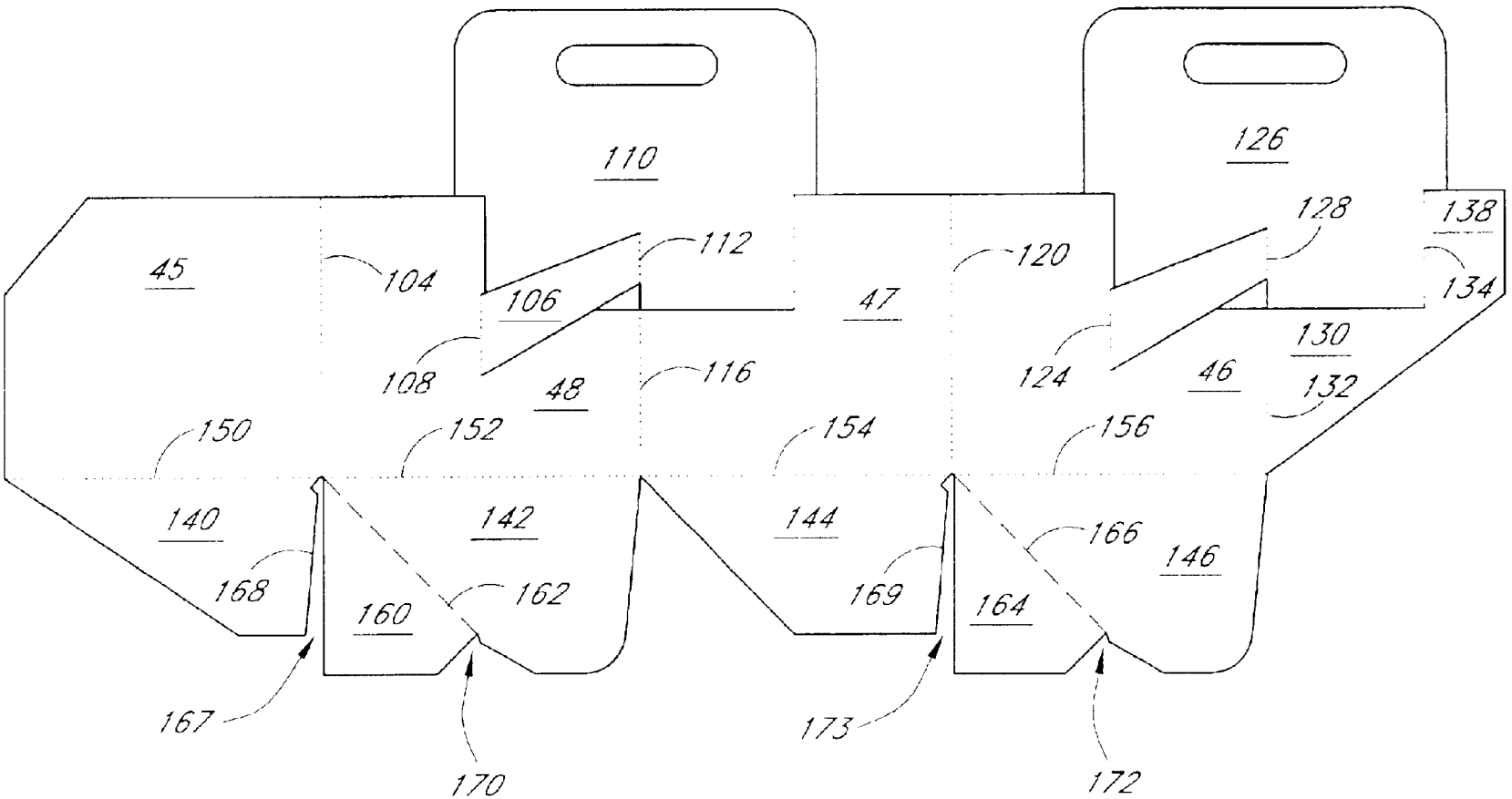
FIG. 14 is an elevational view of the cardboard sheet cut to form the lower beverage carrier.

Referring to FIG. 14, the lower beverage carrier 25 is constructed by folding the sheet of cut cardboard along the dotted lines as follows: With wall section 48 held flat, wall section 45 is folded upwardly along line 104 to form a crease along line 104. Likewise, pocket divider member 106 is folded upwardly with respect to section 48 along line 108 but is folded downwardly with respect to handle section 110 along line 112, leaving creases along lines 108 and 112. Wall section 47 is folded upwardly with respect to wall section 48 along line 116 to form a crease along line 116.

Wall section 46 is then held flat and wall section 47 is folded upwardly along line 120 with respect to wall section 46 to form a crease along line 120. Likewise, a second pocket divider member 122 is folded upwardly with respect to wall section 46 along line 124, but is folded downwardly with respect to the second handle section 126 along line 128 leaving creases along lines 124 and 128. In addition, end tab 130 is folded upwardly with respect to section 46 along line 132. The end tab 130 is also folded with respect to handle section 126 along line 134 such that the end tab portion 138 is raised upwardly with respect to handle section 126 so that the connector 122 and end tab 130 lie in parallel planes with creases formed along lines 132 and 134.

Attached to wall sections 45, 48, 47 and 46 are respective bottom flaps 140, 142, 144 and 146. Each of these flaps are folded upwardly with respect to wall section 45, 48, and 47 along respective lines 150, 152, 154 and 156 to form creases along these lines.

Bottom flap 142 includes a corner tab portion 160 which is folded downwardly with respect to the remainder of flap 142 along line 162. Similarly, bottom flap 146 includes a corner tab portion 164 which is also folded downwardly with respect to the remainder of flap 146 along line 166 with creases left along lines 162, 166.

The lower container is advantageously manufactured in a collapsed configuration as follows: the sections 45, 48, 47 and 46 are folded along creases 104, 116, 120 and 124 to form the outside walls of the container. The downwardly facing side of handle section 126 is joined by a suitable glue or adhesive to the upwardly facing side of the handle section 110 wall. The downwardly facing side of end tab 130 is secured by glue or adhesive to the upwardly facing side of section 45. The upwardly facing surface of tab 160 is joined by glue or adhesive to the downwardly facing side of flap 140. The upwardly facing surface of tab 164 is joined to the downwardly facing side of flap 144.

Figure 5:
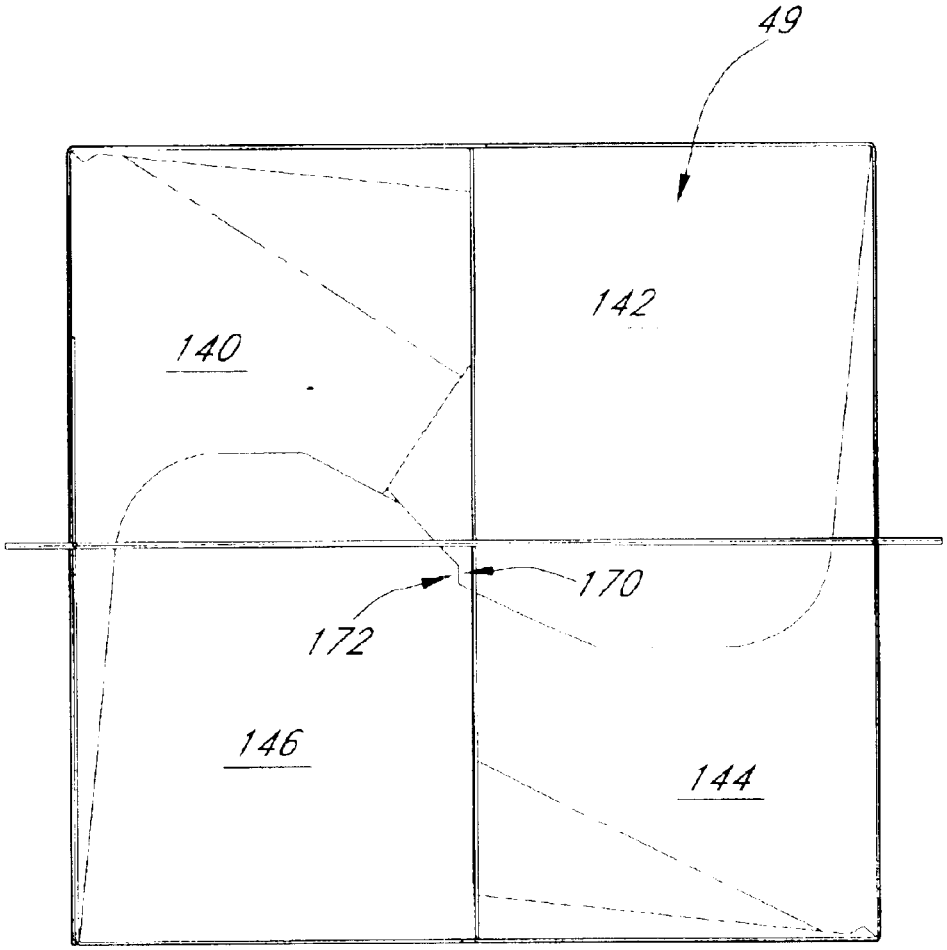
FIG. 5 is a top view of the beverage carrier.
Figure 6:
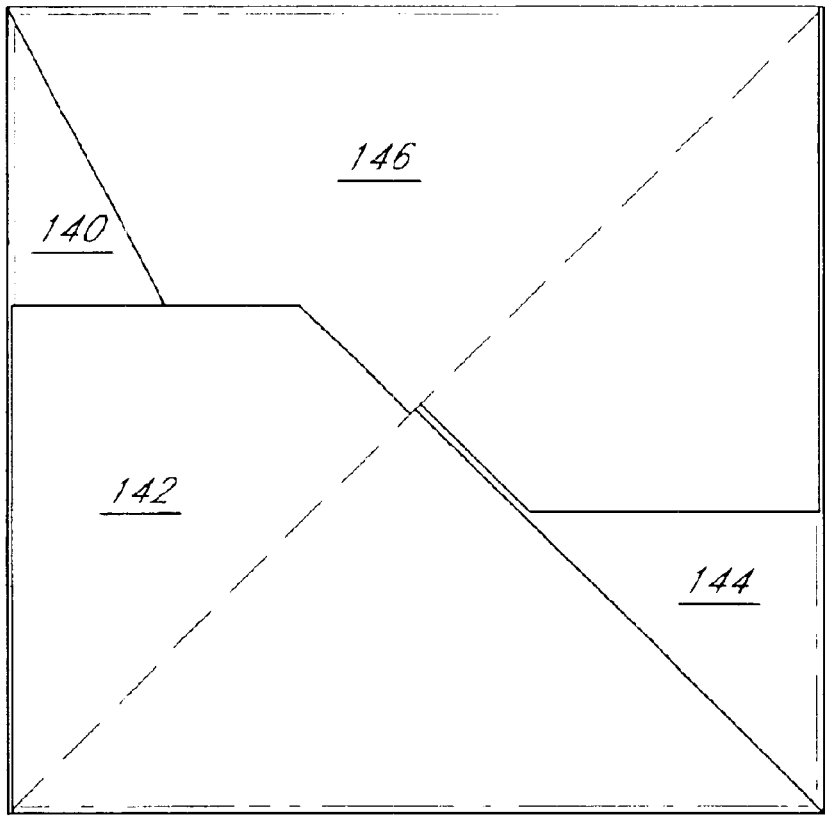
FIG. 6 is a bottom view of the beverage carrier.

A significant feature of the construction of the bottom flaps 140, 142, 144 and 146 is that when the carrier is erected into the configuration shown in FIG. 1A, the bottom flaps 140, 142, 144 and 146 overlap to form the interlocked bottom surface 49 which supports as many filled beverage containers as can be placed into the carrier. A particular feature of the bottom flaps 140 and 144 is the inclusion of respective notches 170, 172. As best shown in FIGS. 5 and 6, as the four bottom flaps 140, 142, 144 and 146 fold together, the notches 170, 172 are drawn together to interlock with each other to maintain the carrier in the erected state shown in FIG. 1A.

The functionality of the foldable carrier is further enhanced by the creases 150, 152, 154, 156, 162 and 166 which bias the bottom surface upward 49 when the carrier is open. As a result, the weight carrying capacity of the carrier is more than ample for all of the drinks that can be held within the carrier.

Figure 17:
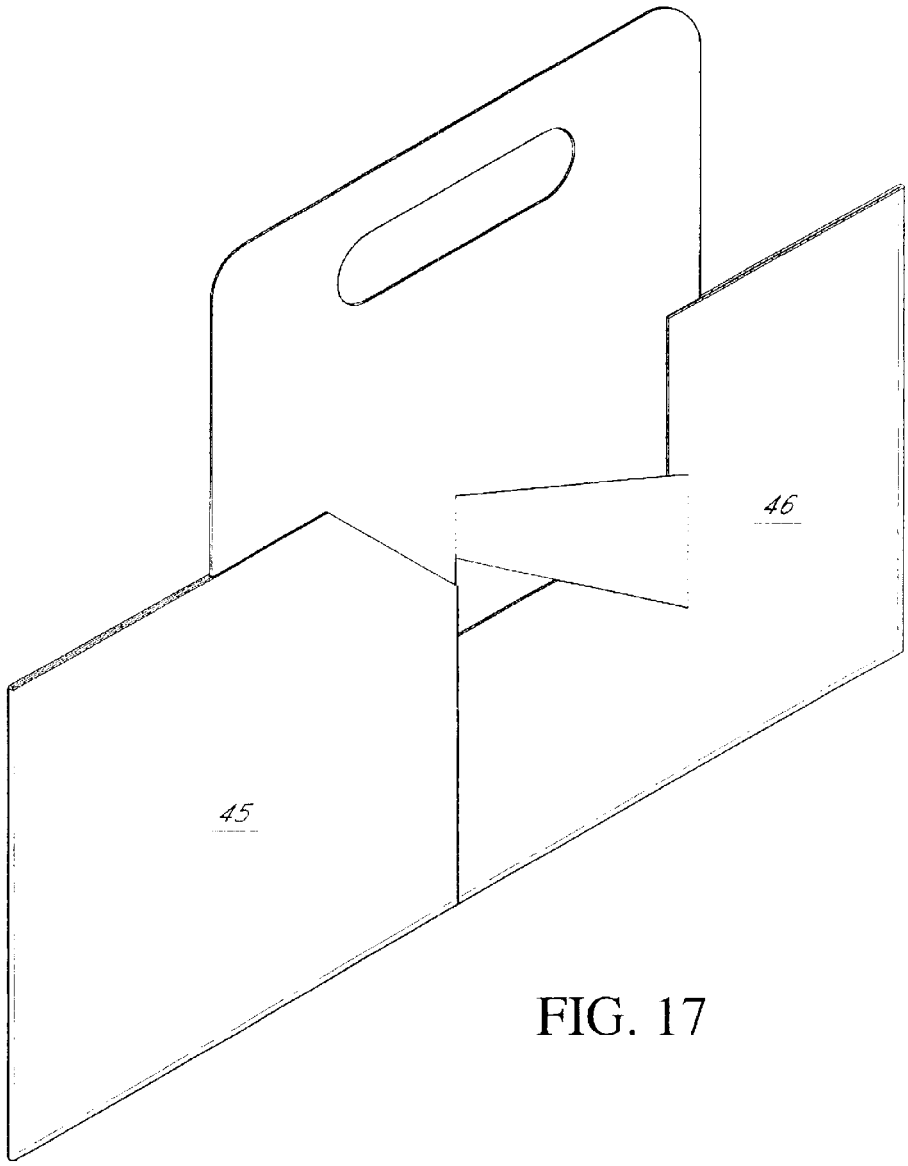
FIG. 17 is a perspective view of the lower beverage carrier in its manufactured collapsed state.

Another feature shown in FIG. 14, is the wedge shaped portion cut from bottom flaps 140 and 144. The wedge cut from flap 140 leaves a wedge-shaped space 167 between the edge 168 of flap 40 and the juxtaposed edge of tab 160. The small wedge shaped portion cut from bottom flap 144 leaves a wedge shaped space 173 between the edge 169 of flap 144 and the juxtaposed edge of tab 164. These relieved edges 168, 169 facilitate manufacturing the lower carrier in the collapsed state shown in FIG. 17. Thus, edge 168 folds into the crease 104 formed between panels 102 and 100 and edge 169 folds into the crease 120 between panels 114, 118. The overall thickness of the collapsed beverage carrier shown in FIG. 17 is substantially only five times the thickness of the cut sheet material used to form the beverage carrier.

Figure 15:
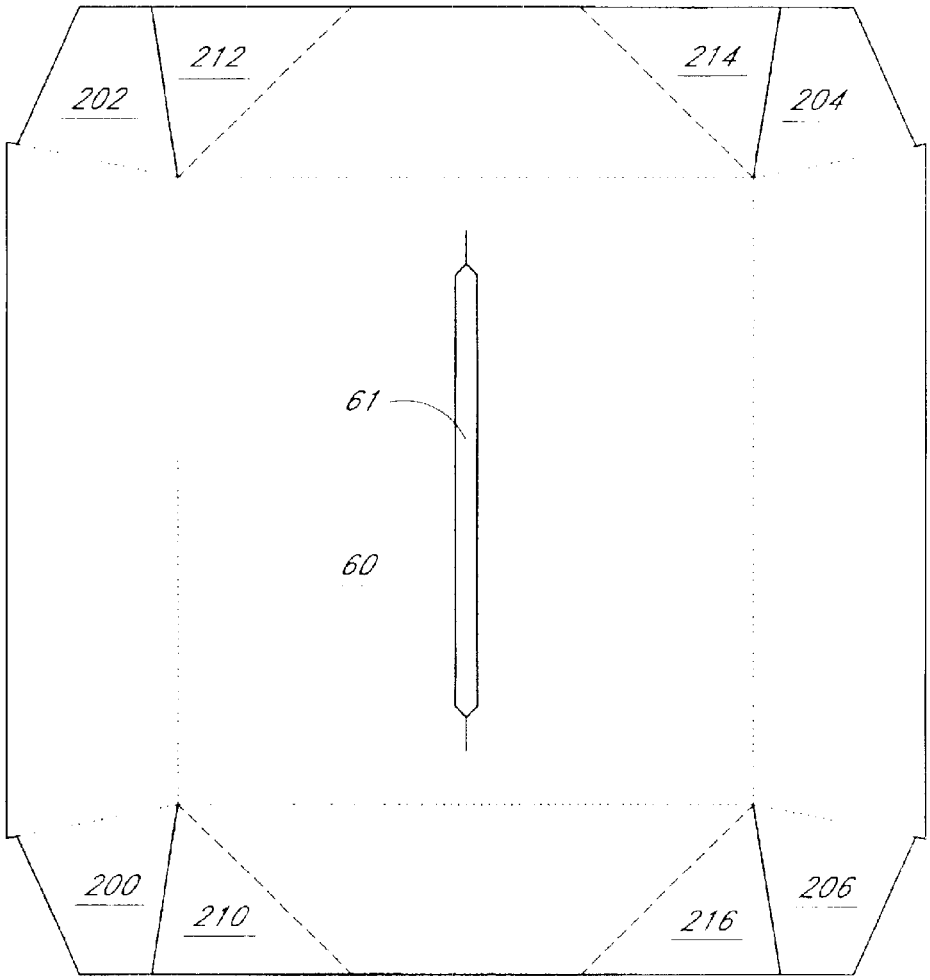
FIG. 15 is an elevational view of the cardboard sheet cut to form the upper food tray.
Figure 18:
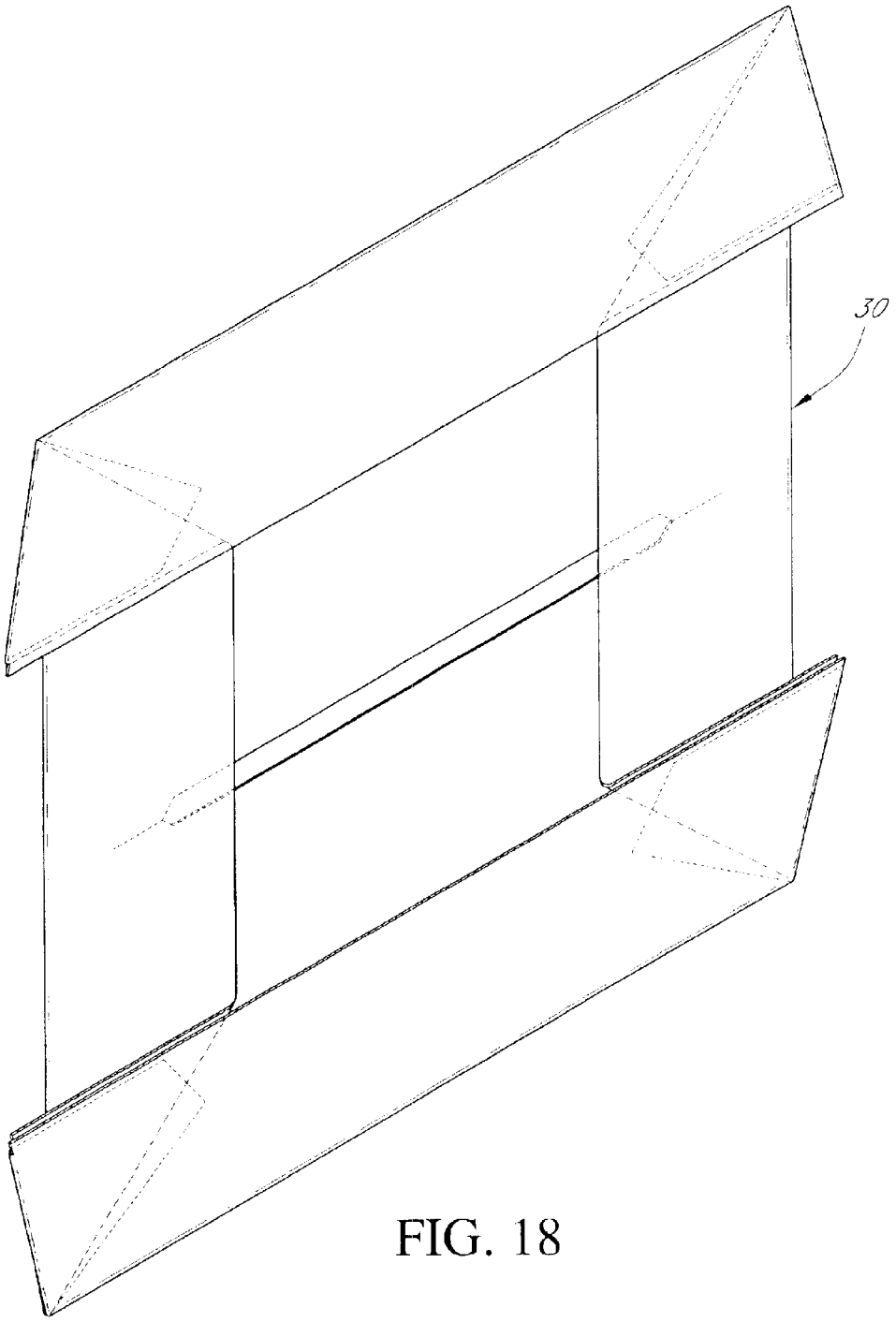
FIG. 18 is a perspective view of the upper food tray in its manufactured collapsed state.

The upper food tray 30 is also advantageously cut from a sheet of cardboard in the manner shown in FIG. 15. The downwardly facing sides of end tabs 200, 202, 204 and 206 are respectively glued to the upwardly facing sides of foldable portions 210, 212, 214 and 216. As a result, this food tray is easily manufactured in a collapsed state as shown in FIG. 18 but is quickly assembled into the food tray 30. The overall thickness of the collapsed tray shown in FIG. 18 is substantially only five times the thickness of the cut sheet material used to form the tray.

After the beverages are placed within the lower carrier 25, the tray slot 61 is easily slipped over the handle 50 until the tray is supported by the top edges of the four walls of the lower carrier as shown in FIGS. 13 and 16.

The floor of 60 tray 30 is thus retained horizontal with respect to the floor 49 of the beverage carrier 25 by the top edges of the side walls 45, 46, 47 and 48, so that there is no risk of food spilling out on the ground when the lower carrier is set on the ground.

Figure 19:
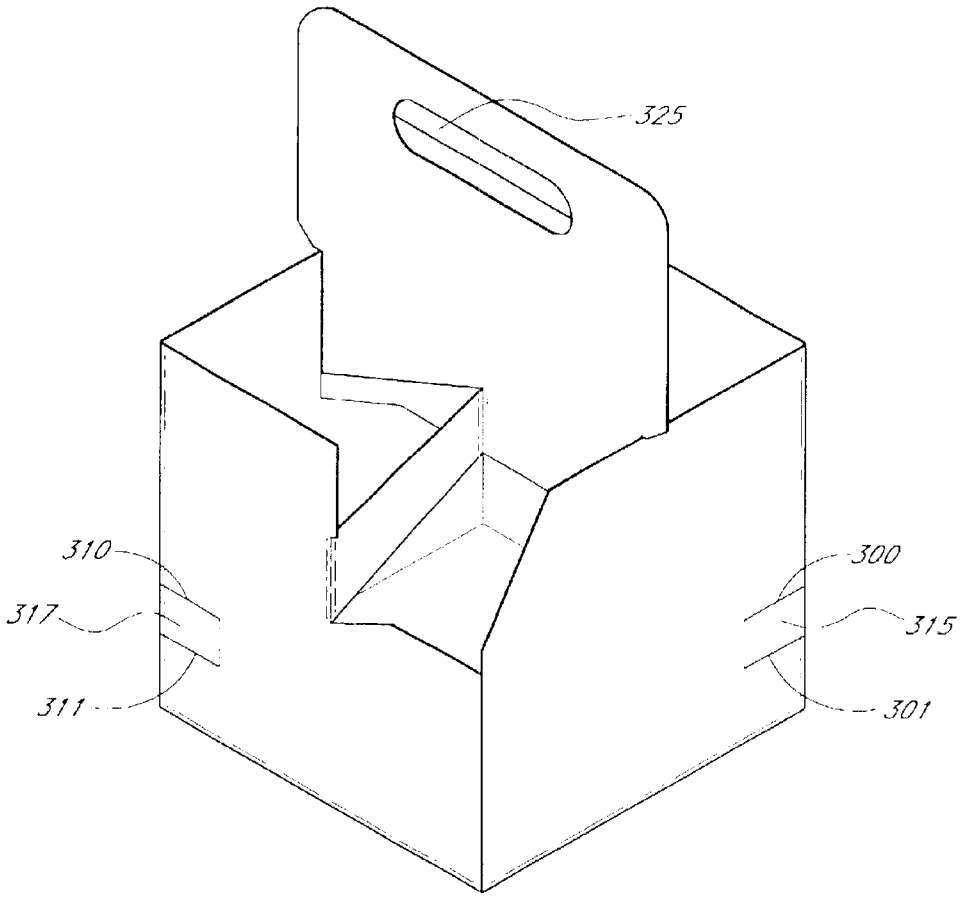
FIG. 19 is a perspective view of the lower beverage carrier of another embodiment of the present invention.
Figure 20:
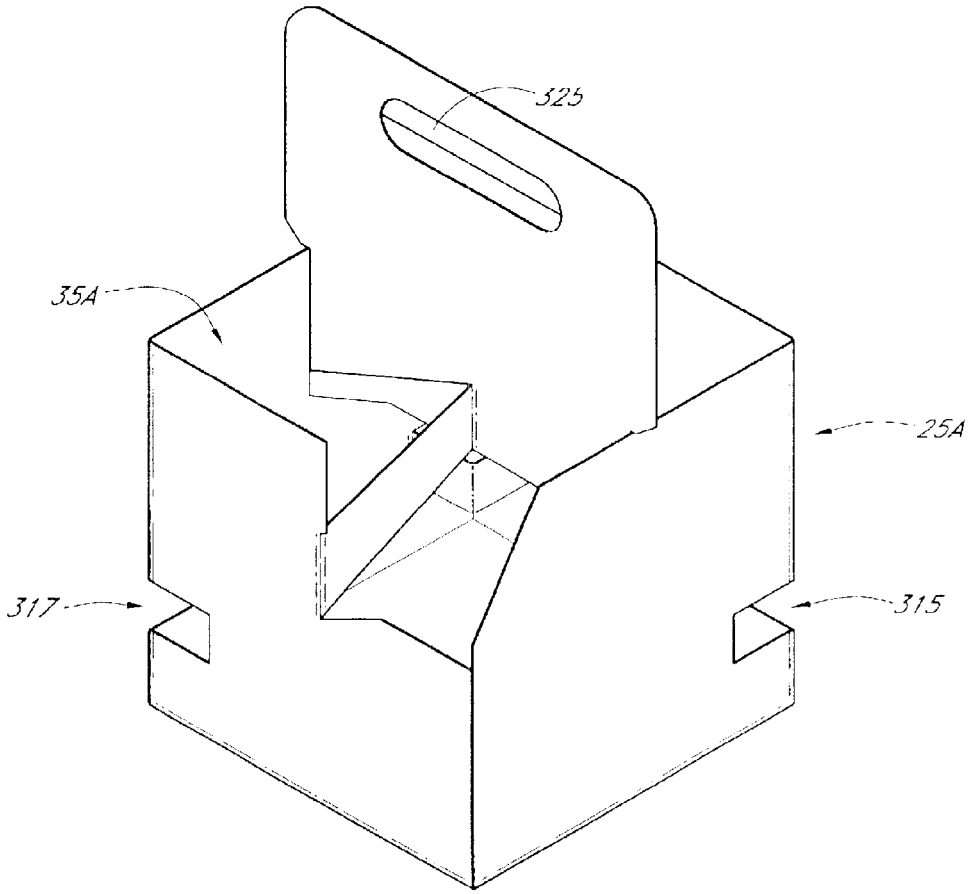
FIG. 20 is another perspective view of the lower beverage carrier of the embodiment of FIG. 19.

Another preferred embodiment of the food and drink carrier constructed in accordance with this invention is shown in FIGS. 19–23. As shown in these figures, a series of parallel slot pairs 300, 301; 305, 306; and 310, 311 are cut in the bottom half of the panels used to form three of the four pockets 35A of the lower beverage carrier 25A. These slots extend through respective creases 105A, 106A and 12A between adjacent panels of the lower beverage carrier to form a series of cardboard straps 315, 316 and 317 serving as cup restraint members to aid in holding beverage containers within the pockets. As shown in FIG. 20, these cardboard straps have been pushed into the pockets of the beverage container to produce an interior wedge or restrain for engaging the exterior walls of the beverage container to hold them upright in the lower beverage carrier 25A.

As shown in FIG. 19, these straps, if not needed, can remain flat within the outer walls of the beverage container 25A. Alternatively, just one or two straps can be pushed into a pocket to aid in restraining beverage carriers against movement and tipping.

Figure 21:
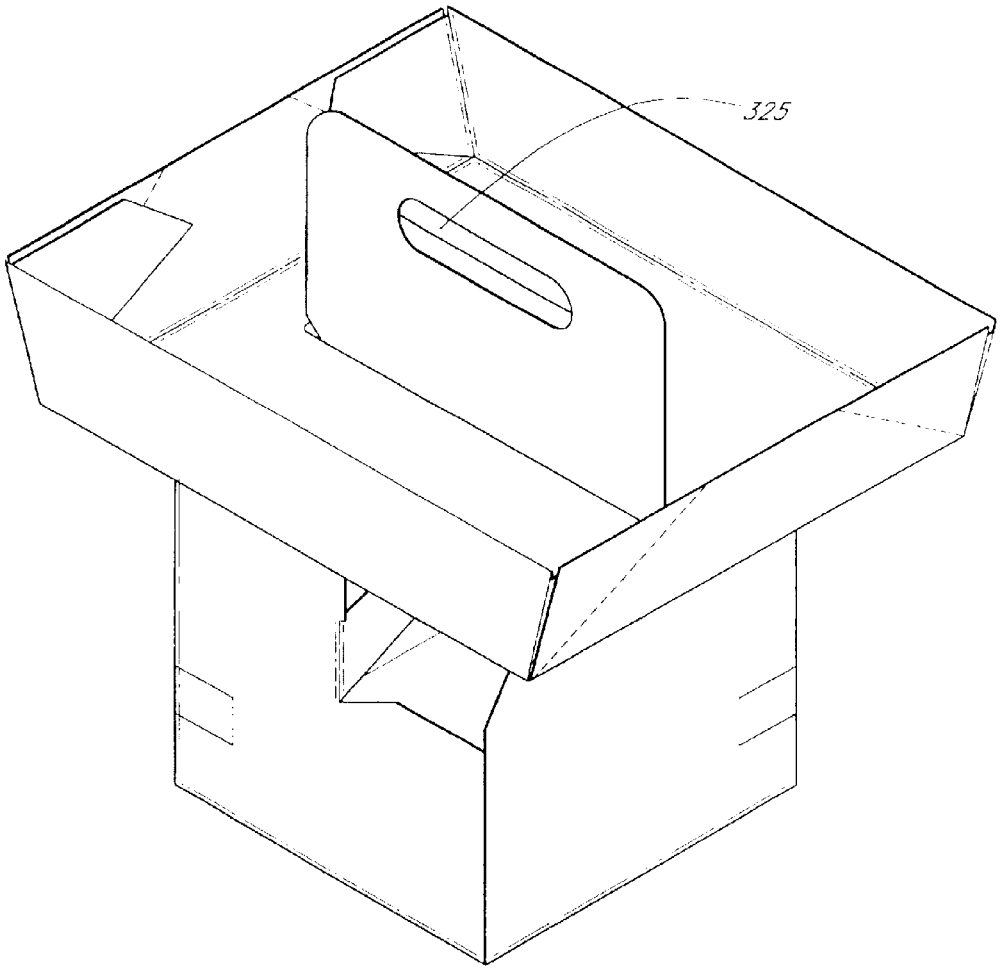
FIG. 21 is a perspective view showing the embodiment of FIGS. 19 and 20 mounting an upper food tray.
Figure 22:
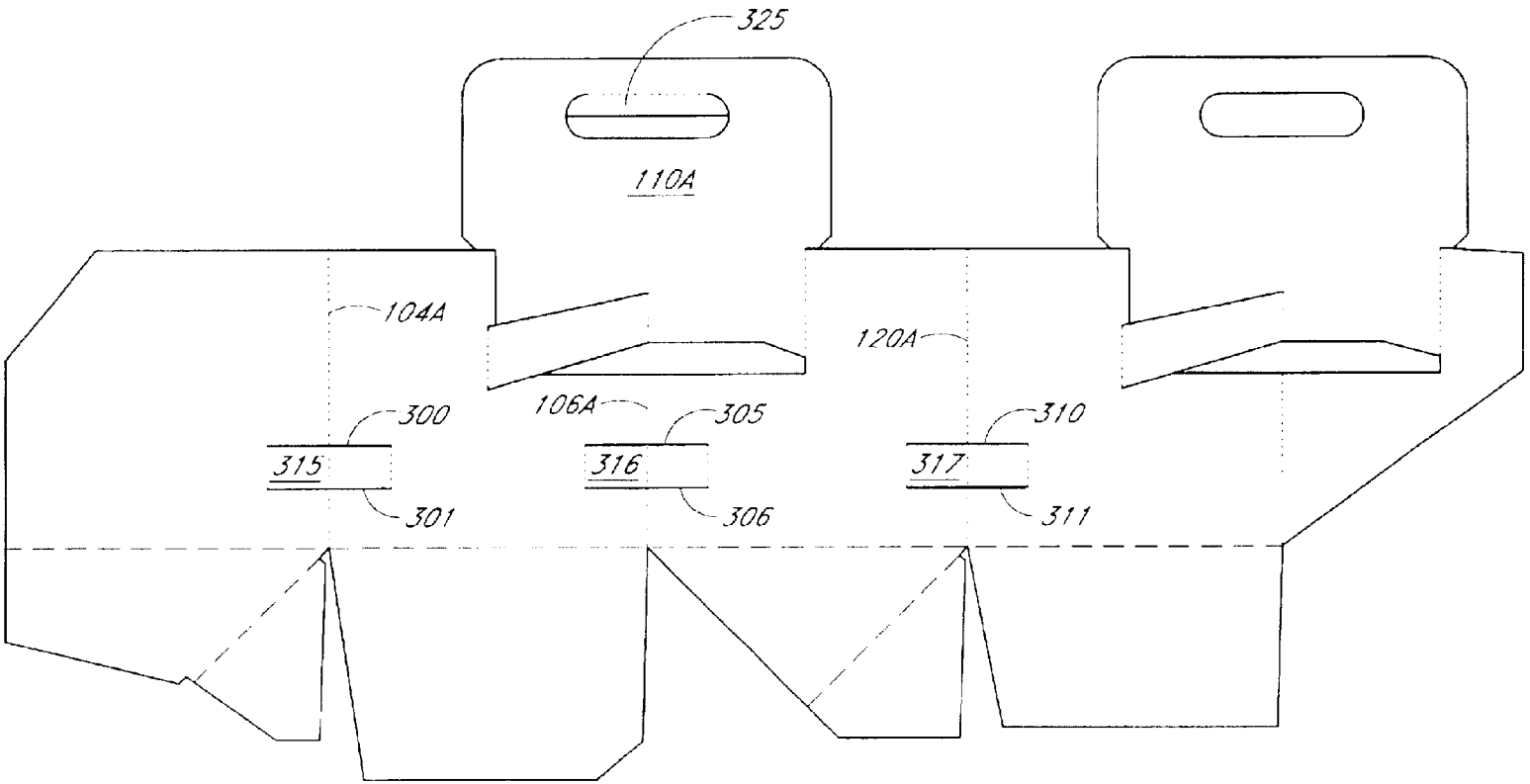
FIG. 22 is an elevational view of the cardboard sheet cut to form the lower beverage carrier of FIGS. 19–21.
Figure 23:
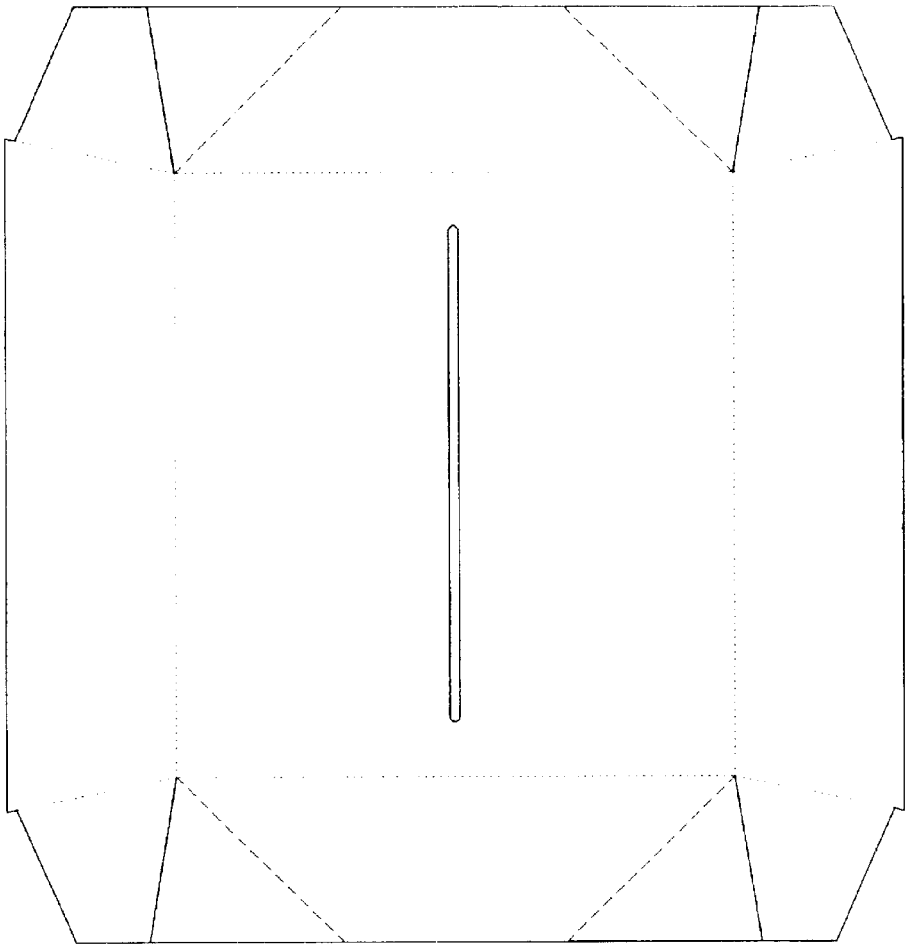
FIG. 23 is an elevational view of the cardboard sheet cut to form the upper food tray of FIG. 21.

Another feature of the lower beverage carrier shown in FIGS. 19–22 and also FIGS. 24–27 is an enhanced handle in which panel 110A is formed with an extra handle flap of cardboard 325 typically one-half inches wide. After the cardboard has been cut as shown in FIG. 22 and folded as shown in FIGS. 19–21, the handle flap 325 is folded upwardly to provide an additional thickness of cardboard to provide a stronger handle and makes carrying the beverage carrier more comfortable.

Figure 24:
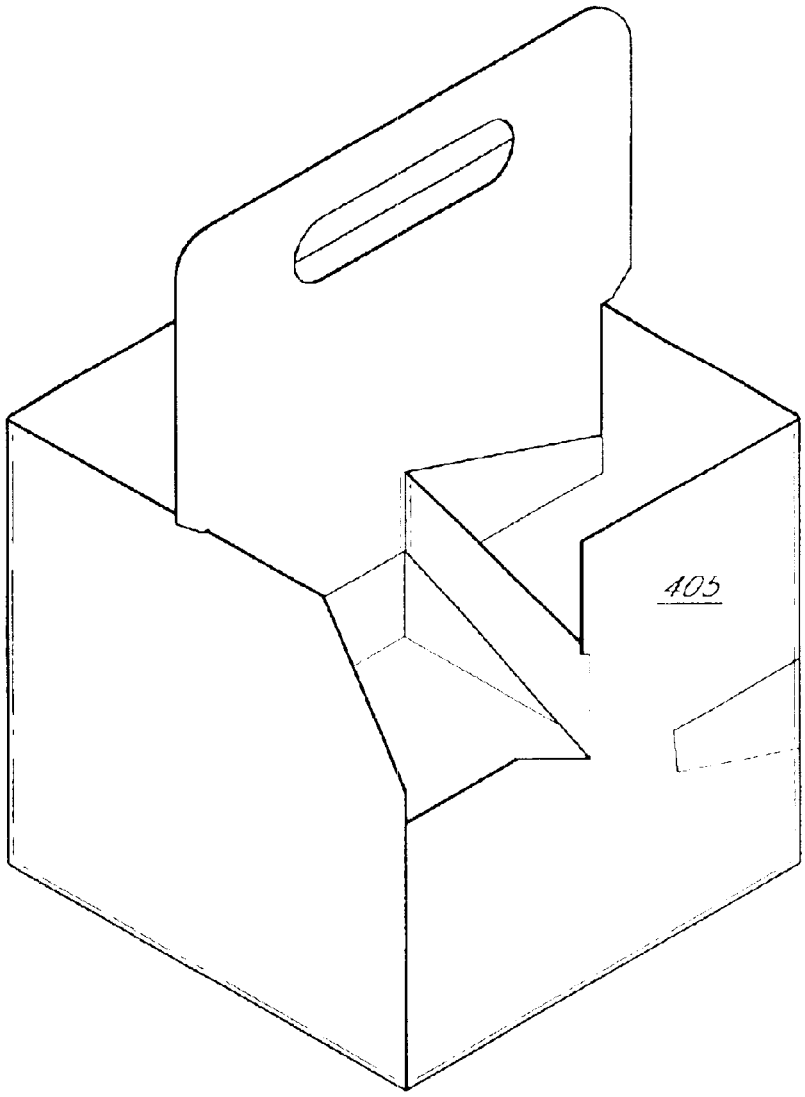
FIG. 24 is a perspective view of the lower beverage carrier of still another embodiment of the present invention.
Figure 25:
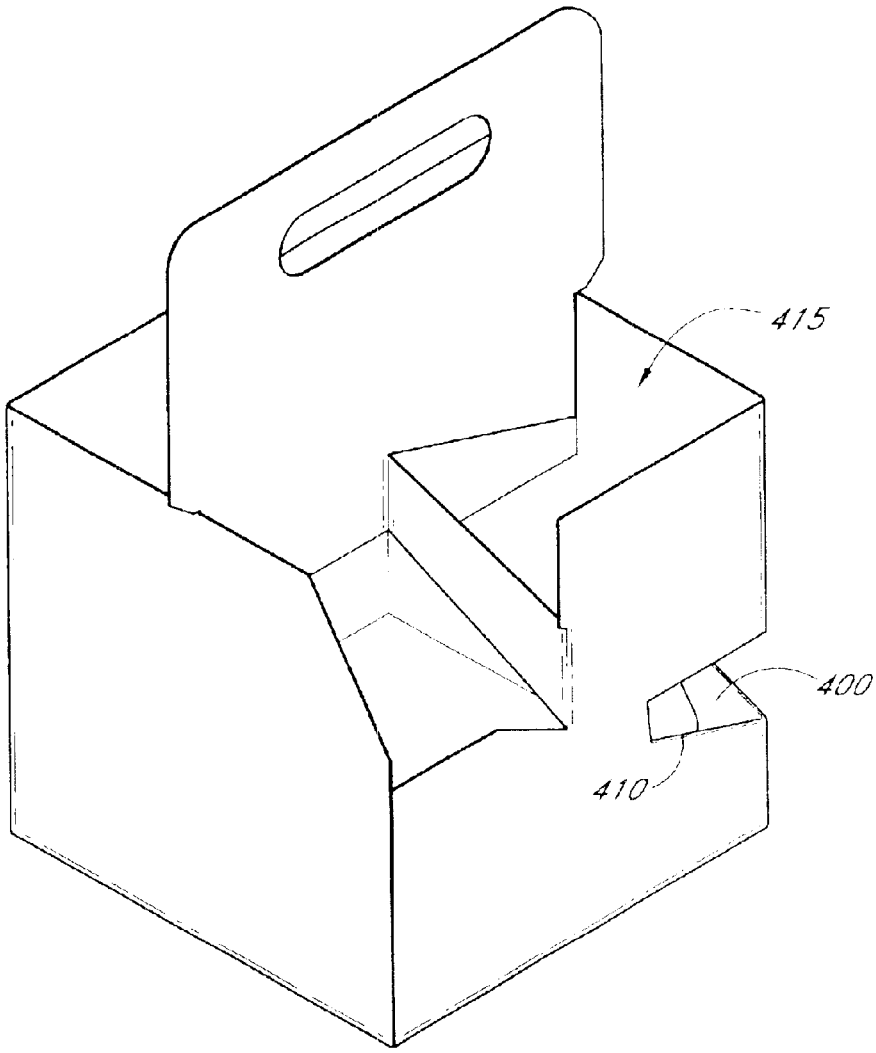
FIG. 25 is another perspective view of the lower beverage carrier of the embodiment of FIG. 24.
Figure 26:
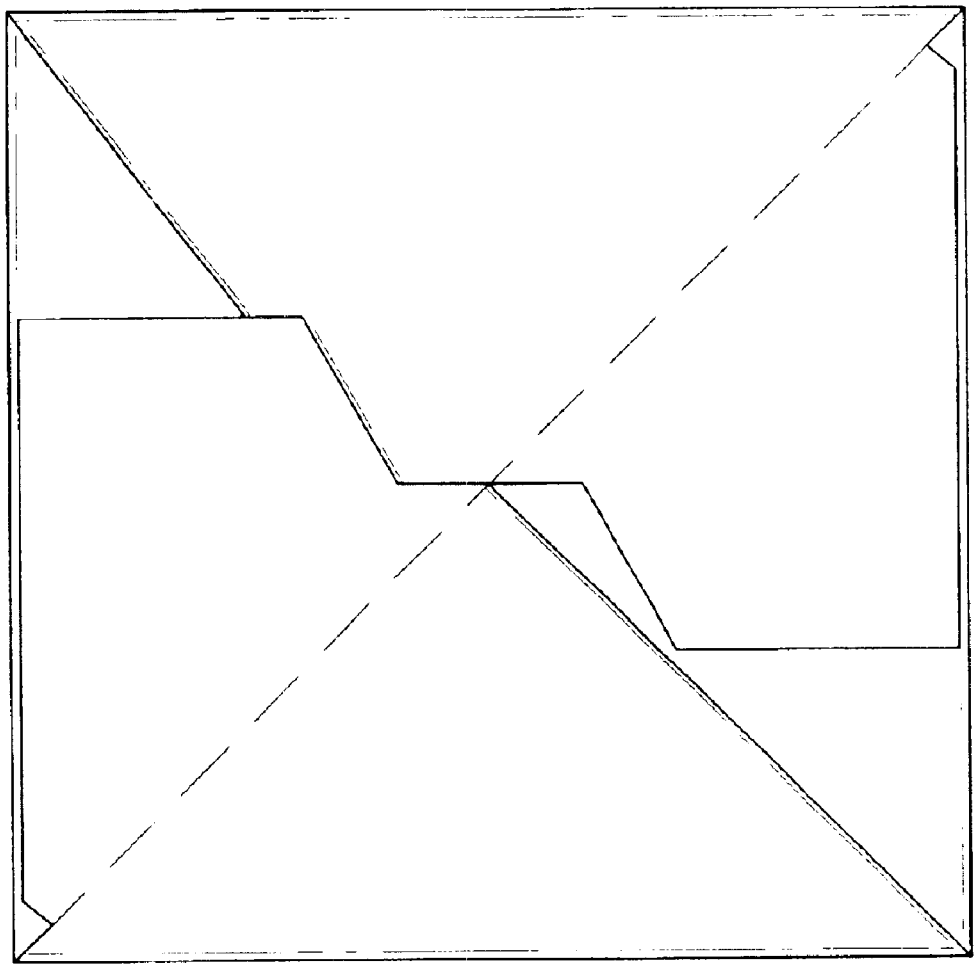
FIG. 26 is a bottom view of the beverage carrier of FIGS. 24 and 25.
Figure 27:
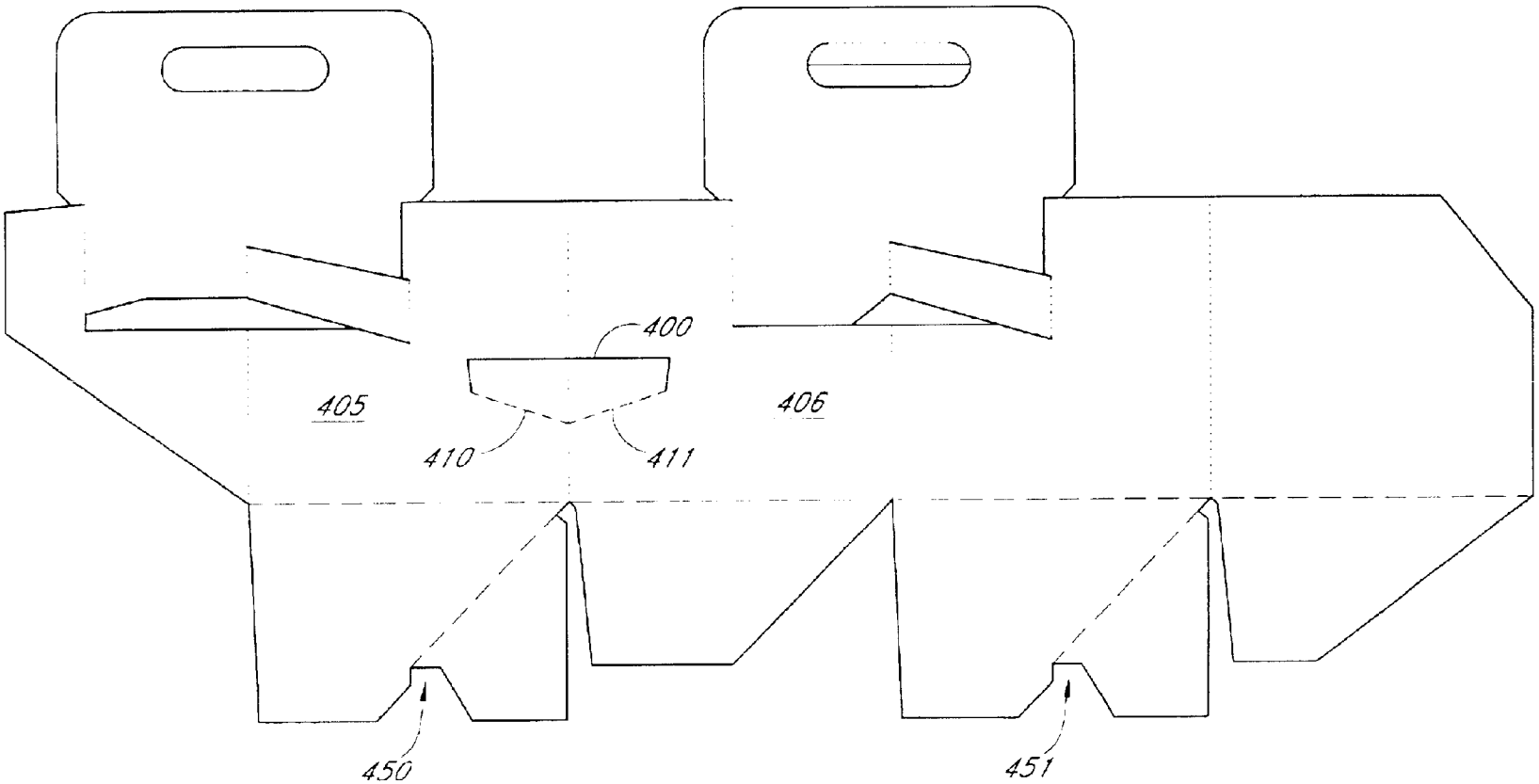
FIG. 27 is an elevational view of the cardboard sheet cut to form the lower beverage carrier of FIGS. 24–26.

FIGS. 24–27 illustrate another preferred embodiment of the carrier constructed in accordance with this invention. As shown in FIGS. 24, 25 and 27, an alternate beverage cup restrainer is provided by an inverted trapezoid 400 cut in the bottom half of two adjacent panels. As shown in FIG. 25, the inverted trapezoid-shaped piece 400 can be folded in on crease lines 410, 411 to provide a cardboard flap within pocket 415 of the beverage carrier to restrain the beverage cup from moving or tipping. Also, as shown in FIG. 24, when flap 410 is not needed to restrain beverage cups, this flap 410 can remain flat within the outer walls 405, 406 of the beverage carrier.

It will be apparent that additional flaps 410 can be provided by cutting additional inverted trapezoid-shaped cuts in other adjacent panels.

FIGS. 26 and 27 illustrate an alternate bottom flap having locking notches 450, 451 for firmly locking the base flaps together when the carrier is assembled for providing additional bottom strength for the carrier.

Figure 28:
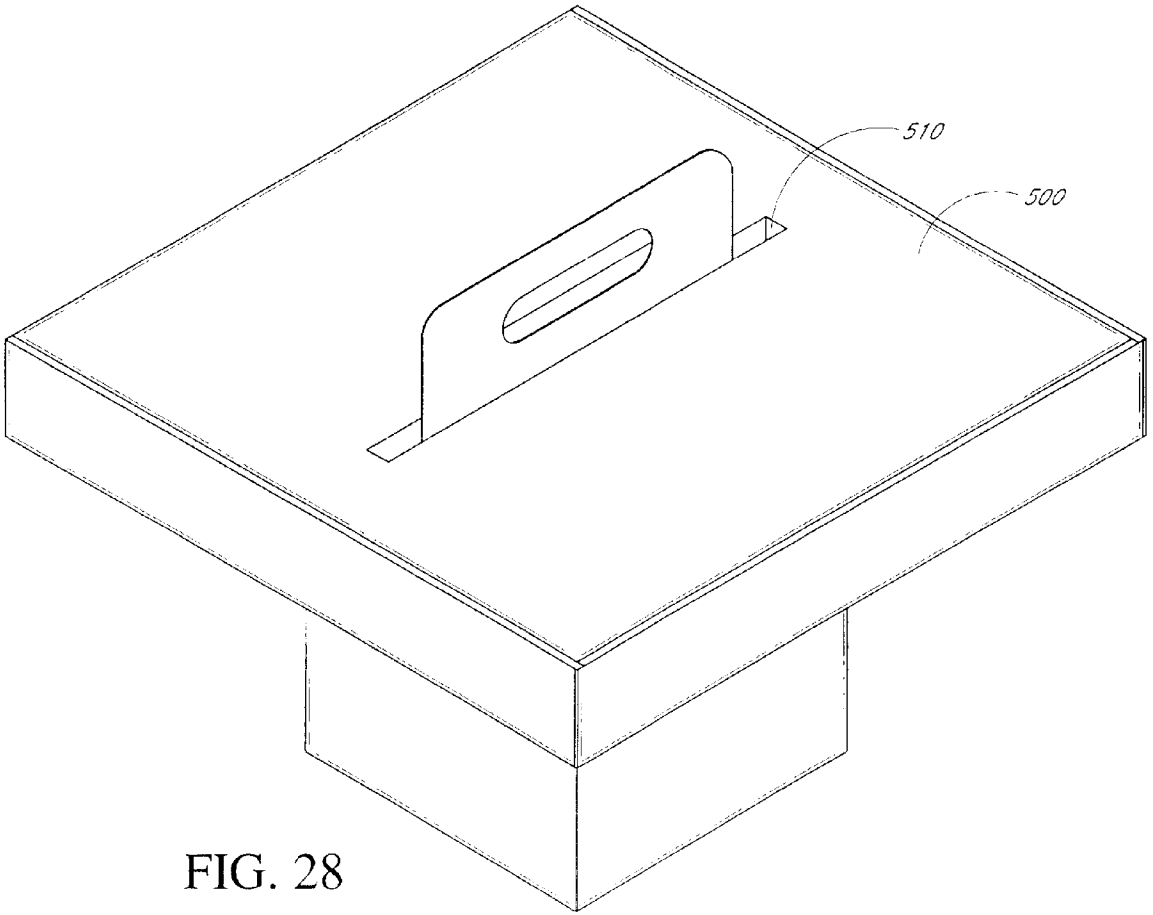
FIG. 28 is a perspective view of the lower beverage carrier supporting an upper food box.

FIG. 28 illustrates the lower beverage carrier of the invention carrying an upper food box 500 having an elongated slot 510 in both its bottom and top. Typically, box 500 has a cover which substantially covers the top of the box and is used for carrying pizzas, although it will be apparent that it can carry many other food products.

The preferred embodiments of beverage and food carriers of the invention are manufactured from single sheets of cardboard. Suitable cardboard sheets are available in a range of thickness, an exemplary range of thicknesses being 0.016 to 0.028 inches. Thinner thicknesses are normally advantageously used for the upper food tray in which lighter loads are normally carried whereas thicknesses of 0.020 to 0.028 are typically used for the lower beverage carrier for carrying the heavier beverage containers. Typical kinds of cardboard sheets useful for constructing the upper and lower carriers including:

1. Plain Chip or Uncoated;
2. Clay coated for enhanced printing of advertising, coupons, and the like on the surfaces of the containers; and
3. Water resistant coated to provide substantial wet strength to carry spilled and leaking beverage containers.
4. By way of specific example, Riverwood International manufactures such uncoated and coated cardboard sheets under the respective trademarks Kraftsmaster®, Omni-Kote®, Pearl-Kote® and Aqua-Kote®.

The food and beverage containers constructed in accordance with the preferred embodiments of the invention have several significant advantages including:

1. The container is manufactured and shipped collapsed and quickly and easily assembled at the ballpark or football stadium. The collapsed carrier (see e.g. FIGS. 17 and 18) is substantially only five times the thickness of the sheet of cut material used to form the lower carrier.

2. The bottom of the beverage containers 40 carried by the carrier are supported by the bottom interlocked flaps of the carrier and are not disturbed when the beverage and food carrier is set on the ground. The beverages are thus protected when the carrier is set on the floor or ground.

3. The upper and lower portions of the food and drink carrier are inexpensively formed from single sheets of cardboard.

In addition to providing a very simple and inexpensive way to manufacture in volume a very useful food and beverage carrier, the preferred embodiments of the invention facilitate the selling of advertising space since the advertising copy can be simply printed on the sheets of FIGS. 14, 15, 22, 23 and 27 before the sheets are cut. Carriers constructed in accordance with the preferred embodiments of this invention offer a substantial area on the side walls of both the lower and upper carrier for such printed advertising.

What is claimed is:

1. A carrier for beverage containers and food, comprising:

a lower beverage carrier having a bottom and side walls, said side walls having uppermost edges above the tops of the tallest of said beverage containers; and an upper food carrier having a bottom and side walls, said upper food carrier adapted to be positioned over the lower beverage carrier with the bottom of said upper food carrier supported by said uppermost edges of said lower carrier, wherein the area of the bottom of the upper food carrier is greater than the area of the bottom of the lower beverage carrier, and wherein said bottom is formed by four interlocking flaps respectively integral with said side walls.

2. The carrier of claim 1, wherein said lower carrier is formed from only a single cut sheet of material.

3. The carrier of claim 2, wherein said lower carrier is manufactured in a collapsed state which is substantially five times the thickness of said sheet of material.

4. The carrier of claim 1, wherein said lower carrier has a plurality of compartments adapted to hold beverage containers of various sizes.

5. The carrier of claim 1, wherein said lower carrier is formed from a single sheet of cut cardboard and folded to provide said bottom and said side walls.

6. The carrier of claim 1, wherein two of said flaps are notched, said notches being interlocked when said carrier is erected.

7. The carrier of claim 1, wherein said upper food carrier is formed from a single cut sheet of material and is collapsible to a width of substantially five times the thickness of said sheet.

8. The carrier of claim 1, wherein two of said bottom flaps are formed with a wedge shaped relief to facilitate erection and collapse of said lower carrier.

9. The carrier of claim 1, wherein in normal use the attitude of the upper carrier is maintained substantially the same as the attitude of the lower carrier.

10. The carrier of claim 2, wherein said material is a sheet of uncoated cardboard.

11. The carrier of claim 2, wherein said material is a sheet of coated cardboard.

12. The carrier of claim 5, wherein said cardboard has a thickness of between 0.020 and 0.028 inches.

13. The carrier of claim 5, wherein said cardboard has a thickness of between 0.016 and 0.028 inches.

14. The carrier of claim 1, wherein said upper food carrier is a tray with a substantially open top.

15. The carrier of claim 1, wherein said upper food carrier is a box having a substantially closable top.

16. A carrier for beverage containers and food, comprising:

a lower beverage carrier having a bottom and side walls, said side walls having uppermost edges above the tops of the tallest of said beverage containers; and an upper food carrier having a bottom and side walls, said upper food carrier placed over the lower beverage carrier with the bottom of said upper food carrier supported by said uppermost edges of said lower carrier, wherein said lower carrier has an integral handle formed from two attached layers of said cut sheet.

17. The carrier of claim 16, wherein said upper food carrier has a slot in the bottom thereof through which said handle is inserted to position said upper food tray over said uppermost edges of said lower carrier.

18. The carrier of claim 16, wherein one of said layers includes a flap which is folded over the second of said layers to form an additional thickness for said integral handle.

19. A carrier for beverage containers and food, comprising:

a lower beverage carrier having a bottom and side walls, said side walls having uppermost edges above the tops of the tallest of said beverage containers; and an upper food carrier having a bottom and side walls, said upper food carrier placed over the lower beverage carrier with the bottom of said upper food carrier supported by said uppermost edges of said lower carrier, wherein said lower carrier has a bottom and a plurality of compartments adopted to hold beverage containers of various sizes, wherein a series of parallel slots are cut in adjacent side walls of the lower carrier to form a cup restraint strap in at least one of said compartments.

20. A carrier for beverage containers and food, comprising:

a lower beverage carrier having a bottom and side walls, said side walls having uppermost edges above the tops of the tallest of said beverage containers; and an upper food carrier having a bottom and side walls, said upper food carrier placed over the lower beverage carrier with the bottom of said upper food carrier supported by said uppermost edges of said lower carrier, wherein said lower carrier has a bottom and a plurality of compartments adopted to hold beverage containers of various sizes wherein an inverted generally trapezoidal-shaped slot is cut in adjacent side walls of the lower carrier to form a cup restraint flap in at least one of said compartments.

21. A carrier for beverage containers and food, comprising:

a lower beverage carrier having a bottom and side walls, said side walls having uppermost edges above the tops of the tallest of said beverage containers; and an upper food carrier having a bottom and side walls, said upper food carrier adapted to be positioned over the lower beverage carrier with the bottom of said upper food carrier supported by said uppermost edges of said lower carrier, wherein the area of the bottom of the upper food carrier is greater than the area of the bottom of the lower beverage carrier, wherein said lower carrier is formed from only a single cut sheet of material which is manufactured in a collapsed state which is substantially five times the thickness of said sheet of material.

* * * * *